US012636754B2

(12) United States Patent
Lasser et al.

(10) Patent No.: US 12,636,754 B2
(45) Date of Patent: May 26, 2026

(54) SINGLE MOTION, ERGONOMIC FAIL-TO-SAFE TRIGGER/SWITCH WITH RAPIDLY ADJUSTABLE SECUREMENT

(71) Applicant: Triton Systems, Inc., Chelmsford, MA (US)

(72) Inventors: Jason Lasser, Andover, MA (US); Jameson Moore, Brooklyn, NY (US); Marmaduke J. Loke, Encinitas, CA (US); James F. Saunders, Lowell, MA (US); Tyson Lawrence, Highlands Ranch, CO (US)

(73) Assignee: Triton Systems, Inc., Chelmsford, MA (US)

( * ) Notice: Subject to any disclaimer, the term of this patent is extended or adjusted under 35 U.S.C. 154(b) by 0 days.

(21) Appl. No.: 19/231,006

(22) Filed: Jun. 6, 2025

(65) Prior Publication Data

US 2025/0375854 A1 Dec. 11, 2025

Related U.S. Application Data

(60) Provisional application No. 63/657,647, filed on Jun. 7, 2024.

(51) Int. Cl.
*B24C 5/02* (2006.01)
*B24C 3/06* (2006.01)

(52) U.S. Cl.
CPC . *B24C 5/02* (2013.01); *B24C 3/06* (2013.01)

(58) Field of Classification Search
CPC ..... A62C 33/04; B25F 5/026; B05B 15/63; B24C 5/02; B25G 3/20
See application file for complete search history.

(56) References Cited

U.S. PATENT DOCUMENTS 128,155 A * 6/1872 Lowe ..... B65G 7/12 294/16
877,012 A * 1/1908 Sullivan ..... B65G 7/12 294/16
1,058,926 A * 4/1913 Toole ..... B65G 7/12 294/16
2,042,385 A * 5/1936 Boring ..... B65D 90/00 362/396
4,470,177 A * 9/1984 Ganung ..... A62C 33/04 24/270
4,723,800 A * 2/1988 Sanders ..... B64G 4/00 294/119.2
4,838,465 A * 6/1989 Metzger ..... E04G 21/04 222/526
4,932,592 A * 6/1990 Abbott ..... B05B 15/62 239/587.5

(Continued)

*Primary Examiner* — Joel D Crandall
(74) *Attorney, Agent, or Firm* — CALDWELL LLC

(57) ABSTRACT

A handle assembly for a media blast hose including a handle grip and at least a clamp affixed to the handle grip and configured to secure the handle assembly to the media blast hose. The at least a clamp including a closed ring and a mechanism configured to adjust an amount of friction between the at least a clamp and the media blast hose. In a first engagement position of the at least a clamp, the handle assembly may be linearly and rotationally independent of the media blast hose and in a second engagement position of the at least a clamp, the handle assembly may be rigidly attached to the media blast hose through frictional engagement.

20 Claims, 12 Drawing Sheets

(56) References Cited

U.S. PATENT DOCUMENTS

| | | | | |
|---|---|---|---|---|
| 5,136,757 | A * | 8/1992 | Labonville | F16L 3/1041 24/270 |
| 5,522,761 | A * | 6/1996 | Lessard | B24C 5/02 451/99 |
| 7,275,777 | B1 * | 10/2007 | Urdiales | B65G 7/12 294/16 |
| 9,248,967 | B1 | 2/2016 | Gregg | |
| 2014/0084193 | A1 | 3/2014 | Eliason et al. | |
| 2023/0173640 | A1 * | 6/2023 | Nguyen | B24C 9/00 451/102 |

* cited by examiner

800

SINGLE MOTION, ERGONOMIC FAIL-TO-SAFE TRIGGER/SWITCH WITH RAPIDLY ADJUSTABLE SECUREMENT

CROSS-REFERENCE TO RELATED APPLICATIONS

This application claims the benefit of priority of U.S. Provisional Patent Application Ser. No. 63/657,647, filed on Jun. 7, 2024, and titled "SINGLE MOTION, ERGONOMIC FAIL-TO-SAFE TRIGGER/SWITCH WITH RAPIDLY ADJUSTABLE SECUREMENT," which is incorporated by reference herein in its entirety.

STATEMENT REGARDING FEDERALLY SPONSORED RESEARCH OR DEVELOPMENT

This invention was made with government support under Contract No. FA8222-21-C-0004 awarded by the Department of the United States Air Force. The government has certain rights in the invention.

FIELD OF THE INVENTION

The present invention generally relates to the field of mechanical control systems. In particular, the present invention is directed to single motion, ergonomic fail-to-safe trigger/switch with rapidly adjustable securement.

BACKGROUND

Media blasting, also known as abrasive blasting, is a widely used technique in industries such as construction, manufacturing, and maintenance for cleaning, shaping, or finishing surfaces through the application of high-pressure abrasive materials. The operation typically involves a hose fitted with a trigger or switch mechanism to regulate the material flow. The ergonomics and safety of these systems are critical, as operators often manage heavy equipment for extended periods under demanding conditions. Regulatory standards, such as those set by OSHA, further emphasize the importance of manual safety controls to minimize risk. Accordingly, there is an ongoing interest in improving the comfort, safety, and efficiency of control systems associated with media blast hoses.

SUMMARY OF THE DISCLOSURE

In an aspect, a handle assembly for a media blast hose includes a handle grip and at least a clamp affixed to the handle grip and configured to secure the handle assembly to the hose. The at least a clamp including a closed ring and a mechanism configured to adjust an amount of friction between the at least a clamp and the hose. In a first engagement position of the at least a clamp, the handle assembly may be linearly and rotationally independent of the media blast hose and in a second engagement position of the at least a clamp, the handle assembly may be rigidly attached to the medial blast hose through frictional engagement.

In another aspect, a method for attaching a handle assembly to a media blast hose includes affixing a handle grip to at least a clamp including a closed ring to form a handle assembly, positioning the handle assembly on the media blast hose, and modifying the adjustable diameter of the closed ring using an overcenter lever to adjust an amount of frictional engagement between the at least a clamp and the hose.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

Figure 1:
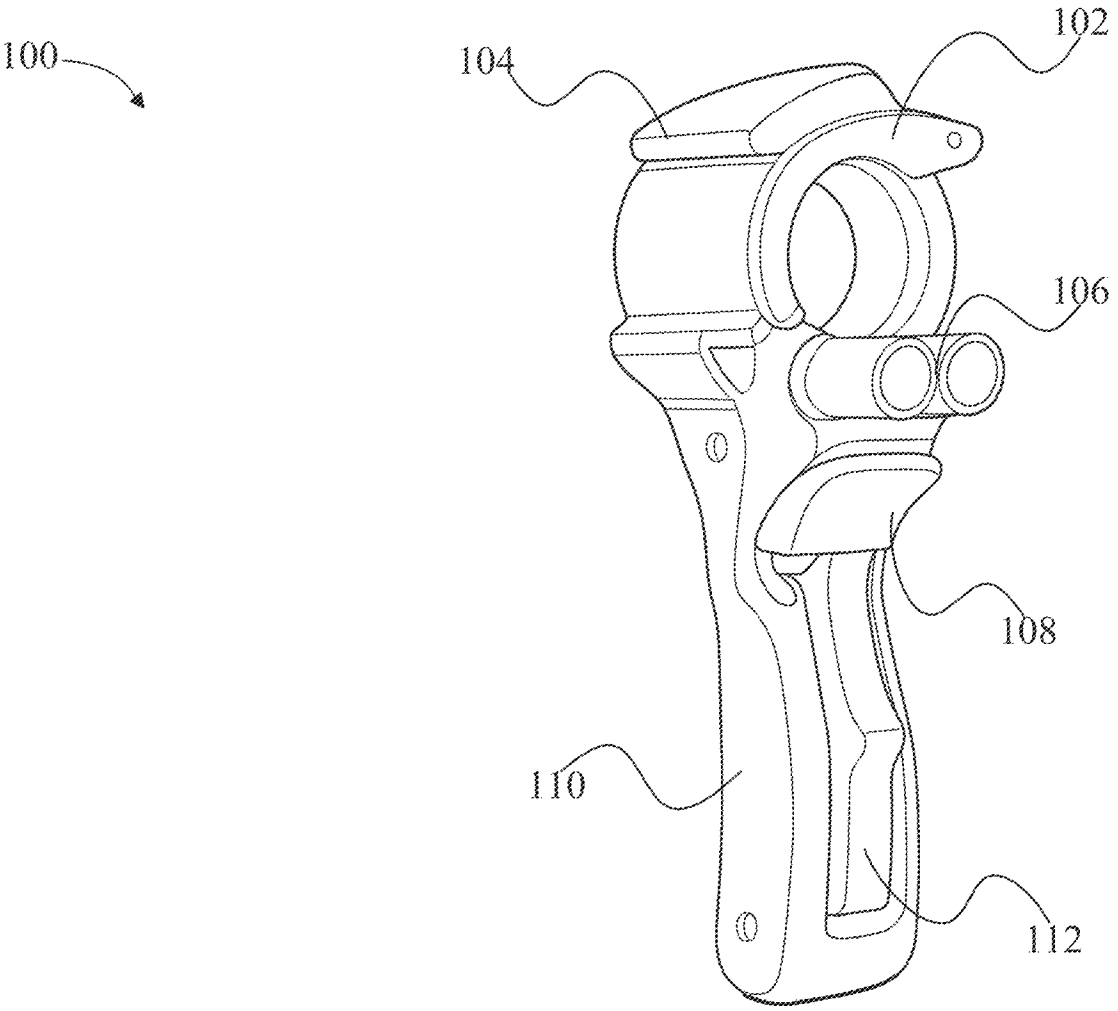
FIG. 1 is an exemplary embodiment of a handle assembly for a media blast hose.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

This disclosure is not limited to the particular systems, devices and methods described, as these may vary. The terminology used in the description is for the purpose of describing the particular versions or embodiments only and is not intended to limit the scope.

As used in this document, the singular forms "a," "an," and "the" include plural references unless the context clearly dictates otherwise. Those having skill in the art can also translate from the plural form to the singular as is appropriate to the context and/or application. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

It will be understood by those within the art that, in general, terms used herein are generally intended as "open" terms (for example, the term "including" should be interpreted as "including but not limited to," the term "having" should be interpreted as "having at least," the term "includes" should be interpreted as "includes but is not limited to," et cetera). While various compositions, methods, and devices are described in terms of "comprising" various components or steps (interpreted as meaning "including, but not limited to"), the compositions, methods, and devices also can "consist essentially of" or "consist of" the various components and steps, and such terminology should be interpreted as defining essentially closed-member groups.

In addition, even if a specific number is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, et cetera" is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, et cetera). In those instances where a convention analogous to "at least one of A, B, or C, et cetera" is used, in general such a construction is intended in the sense one having skill in the art would understand the convention (for example, "a system having at least one of A, B, or C" would include but not be limited to systems that have A alone, B alone, C alone, A and B together, A and C together, B and C together, and/or A, B, and C together, et cetera). It will be further understood by those within the art that virtually any disjunctive word and/or phrase presenting two or more alternative terms, whether in the description, sample embodiments, or drawings, should be understood to contemplate the possibilities of including one of the terms, either of the terms, or both terms. For example, the phrase "A or B" will be understood to include the possibilities of "A" or "B" or "A and B."

In addition, where features of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, et cetera. As a non-limiting example, each range discussed herein can be readily broken down into a lower third, middle third and upper third, et cetera. As will also be understood by one skilled in the art, all language such as "up to," "at least," and the like include the number recited and refer to ranges that can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

The term "about," as used herein, refers to variations in a numerical quantity that can occur, for example, through measuring or handling procedures in the real world; through inadvertent error in these procedures; through differences in the manufacture, source, or purity of compositions or reagents; and the like. Typically, the term "about" as used herein means greater or lesser than the value or range of values stated by 1/10 of the stated values, e.g., ±10%. The term "about" also refers to variations that would be recognized by one skilled in the art as being equivalent so long as such variations do not encompass known values practiced by the prior art. Each value or range of values preceded by the term "about" is also intended to encompass the embodiment of the stated absolute value or range of values. Whether or not modified by the term "about," quantitative values recited in the present disclosure include equivalents to the recited values, e.g., variations in the numerical quantity of such values that can occur, but would be recognized to be equivalents by a person skilled in the art.

At a high level, aspects of the present disclosure are directed to systems and methods for improving the ergonomics, safety, and operational control of a media blast hose through the use of a trigger switch assembly that can be rapidly secured and repositioned along the hose. In an embodiment, the trigger switch assembly comprises a clamp having a closed ring with an adjustable diameter actuated by an overcenter lever, allowing the assembly to be fixed in place or repositioned both linearly and rotationally along the hose or rod.

Aspects of the present disclosure can be used to reduce operator fatigue and enhance control during abrasive blasting operations by enabling quick and secure adjustment of a handle grip. Aspects of the present disclosure can also be used to support modular configurations, such as shim inserts for accommodating hoses of different diameters, or multiple clamps positioned along the hose to support additional handle grips or provide increased positional stability. This is so, at least in part, because the clamp architecture allows consistent and reversible frictional engagement to be applied using an overcenter locking mechanism or other mechanical fastening interface.

Aspects of the present disclosure also enable integration of control features, such as a safety switch, a trigger mechanism, and a twin line control connection, all within the handle grip. These features may provide fail-to-safe actuation and ergonomic benefits by allowing the trigger to be positioned for activation by the thenar web and oriented to work with the weight of the hose. Exemplary embodiments illustrating aspects of the present disclosure are described below in the context of several specific examples.

Media blasting, also known as abrasive blasting, is a process used in a variety of industries, including construction, manufacturing, and maintenance services. It involves directing a high-pressure stream of abrasive material, such as sand or grit, against a surface to clean or shape it. The media blast hose is a pivotal component of this process, serving as the conduit for the abrasive material. The operation of a media blast hose typically involves a trigger or switch mechanism. This mechanism controls the flow of the abrasive material through the hose and out of the nozzle. The design and positioning of this trigger or switch can greatly influence the ease and safety of operation.

Ergonomics is a field of study that considers the interaction between humans and the systems they use, with the goal of improving efficiency and reducing the risk of injury. In the context of media blasting, ergonomics can be applied to the design of the trigger or switch mechanism, as well as the handle or grip used to control the hose. An ergonomic design can help to reduce operator fatigue and the risk of musculoskeletal injuries.

Safety is another paramount concern in media blasting operations. The Occupational Safety and Health Administration (OSHA) in the United States has established specific requirements for the design and operation of media blast equipment. For example, OSHA regulation 1926.302(b)(10) stipulates that abrasive blast cleaning nozzles shall be equipped with an operating valve which requires manual operation to stay open. The concept of a "fail-to-safe" mechanism is relevant in this context. A fail-to-safe mechanism is designed to automatically return to a safe state in the event of a failure or disruption. In the case of a media blast hose, a fail-to-safe trigger or switch will automatically shut off the flow of abrasive material if the operator loses control of the hose or the trigger mechanism.

The design of the attachment mechanism for the trigger or switch to the media blast hose is also a consideration. The attachment mechanism not only secures the trigger or switch to the hose but may also allow for adjustment of the position of the trigger or switch along the length of the hose. This adjustability can contribute to the ergonomic design and safe operation of the media blast hose. Finally, the control connection is a component of the trigger or switch assembly that enables the activation of the switch. This connection can be designed to operate pneumatically or electronically, and its design can influence the ease and safety of operation.

In the media blast industry, there is a pressing demand for an ergonomic, efficient, and durable fail-to-safe remote-control switch. Current equipment necessitates operators to maintain postures and grips that exert undue strain on their wrists, arms, and upper body, leading to operator fatigue and injury. This not only results in loss of labor hours and workforce retention due to musculoskeletal injuries, but may also lead to a decline in productivity due to challenging biomechanical maneuvers to complete tasks for quick turnaround of equipment. Furthermore, the frequent replacement of damaged switches adds to the inefficiencies. Therefore, there is a clear and urgent demand for a solution that combines ergonomic design, safety, and durability with an instant fail-to-safe remote-control switch for the media blast industry.

Referring now to FIG. 1, an exemplary embodiment of a handle assembly 100 for a media blast hose is illustrated. For purposes of this disclosure, a "media blast hose" is a conduit configured to transport a stream of abrasive media from a pressurized source to a nozzle for discharge. Throughout this disclosure the media blast hose may additionally or alternatively be referred to as the hose. In some cases, media blast hoses may be employed in surface preparation operations across a range of industrial, construction, and maintenance environments. For example, media blast hoses may be used in applications such as structural steel cleaning, ship hull descaling, graffiti removal from masonry, and corrosion removal from pipelines or storage tanks. Media blast hoses may experience high internal pressures and substantial abrasive wear during operation, and are often subjected to repeated bending, dragging, or repositioning across uneven surfaces. Due to the dynamic nature of such tasks and the heavy, force-generating characteristics of the hoses themselves, operators may require assistive control structures to reduce fatigue and maintain directional accuracy. Accordingly, it is advantageous to provide a handle assembly that can be securely affixed to the media blast hose while also permitting rapid repositioning along the length or circumference of the hose. The systems and methods described in the present disclosure are configured to meet these demands by providing friction-based, tool-less clamping mechanisms and optional ergonomic features to enhance usability and operator safety. For purposes of this disclosure, "ergonomic" is the design and arrangement of products, systems, or environments to optimize human well-being, comfort, and performance.

With continued reference to FIG. 1, in an embodiment, handle assembly 100 includes at least a clamp 102 affixed to a handle grip 110 and configured to secure the handle assembly to the hose. For purposes of this disclosure, a "clamp" is any mechanical structure configured to secure one component to another to restrict relative movement between the secured components. In the context of the present disclosure, at least a clamp 102 may be configured to couple the handle assembly to a media blast hose or similar cylindrical structure in a manner that permits reversible engagement. In an embodiment, at least a clamp 102 may operate by compressing, enclosing, or otherwise gripping the surface of the hose, and may include structural elements such as a ring, band, jaw, strap, or shell. The at least a clamp 102 may be formed from one or more components and may be configured to be rigid, flexible, segmented, or continuous in construction. Actuation of the clamp may be achieved using mechanical, hydraulic, pneumatic, or manual means, including but not limited to overcenter levers, knobs, bolts, ratcheting interfaces, or quick-release mechanisms.

With further reference to FIG. 1, in some embodiments, the at least a clamp 102 may allow linear and/or rotational repositioning of the handle assembly along the hose when in a first engagement position and may fix the handle assembly in place using frictional or interference engagement when in a second engagement position. In a first engagement position of at least a clamp 102, the handle assembly may be linearly and rotationally independent of the media blast hose. For purposes of this disclosure, "linearly and rotationally independent" means that the handle assembly is capable of both translational movement along the longitudinal axis of the media blast hose and rotational movement about that axis, while remaining mechanically coupled to the hose by the clamp. This condition may allow the user to reposition handle assembly 100 in a continuous motion, (e.g., sliding or twisting it) without detaching or removing at least a clamp 102 or otherwise disassembling any portion of handle assembly 100. For purposes of this disclosure, a "first engagement position" is a state of the clamp in which the clamp is disengaged. For example, the first engagement position may correspond to a relaxed or open condition of the clamp mechanism that permits repositioning of the handle assembly without requiring disassembly or removal of the clamp from the hose. In a second engagement position of at least a clamp 102, the handle assembly may be rigidly attached to the media blast hose through frictional engagement. For purposes of this disclosure, a "second engagement position" is a state of the clamp in which the clamp is engaged. For example, the second engagement position may correspond to a closed or tightened condition of at least a clamp 102 that restricts repositioning of the handle assembly.

In continued reference to FIG. 1, in an embodiment, the at least a clamp 102 may include a closed ring comprising an adjustable diameter. For purposes of this disclosure, a "closed ring" is a continuous or substantially continuous loop structure that defines a central opening and is configured to encircle at least a portion of a cylindrical or tubular object. The closed ring may be formed as a single-piece structure or from multiple interconnected segments that, when joined, define a substantially uninterrupted perimeter around the object. In some embodiments, the closed ring may include a hinge, joint, or separable interface to facilitate opening and closing during installation. An "adjustable diameter," for purposes of this disclosure, refers to the closed ring's ability to vary the size of the internal opening between at least two positions. The at least two positions may include an expanded position, in which the closed ring can be positioned over or around the hose, and a contracted position, in which the closed ring secures the handle assembly in place. The adjustable diameter may be achieved through any mechanical configuration that permits radial expansion and contraction, including but not limited to overcenter levers, cams, threaded actuators, ratchets, buckles, or other tensioning mechanisms. In operation, the adjustable diameter may allow the at least a clamp 102 to apply and release clamping force in a controlled, reversible manner, accommodating hoses of varying sizes or enabling repositioning of the handle assembly.

With continued reference to FIG. 1, in an embodiment, the closed ring may include at least one surface including a knurled texture. For purposes of this disclosure, a "knurled texture" is a patterned surface formed by a series of raised ridges, lines, or grooves that are mechanically or chemically imparted onto a material surface to increase friction and improve grip. In an embodiment, the surface having a knurled texture may be disposed along the interior-facing portion of the closed ring and may include a patterned texture, such as ridges, diamonds, or cross-hatched grooves. This surface treatment may be formed through machining, molding, or chemical etching and may enhance friction between the at least a clamp 102 and the hose by increasing the contact surface roughness. In certain embodiments, the knurling may extend continuously or discontinuously around the interior circumference to facilitate high-friction engagement when the clamp is actuated.

In further reference to FIG. 1, in an embodiment, the closed ring may include a high-friction material layer. For purposes of this disclosure, a "high-friction material" is any material having a static coefficient of friction of at least 0.6 when measured against a steel surface under dry conditions, in accordance with ASTM D1894 or an equivalent standard. Such materials may generate greater resistance to relative motion at an interface than materials with lower coefficients of friction under comparable conditions. This increased resistance may be a product of the materials intrinsic surface properties, compliance, and/or texture. High-friction materials may include elastomers, rubbers, silicones, thermoplastic elastomers, or composite materials designed to enhance grip, reduce slippage, and absorb localized deformation under compressive force. These materials may be selected based on their coefficient of friction, wear resistance, durability under pressure, and compatibility with both the clamp structure and the hose material. In an embodiment, the high-friction material layer may be configured to resist slippage between the at least a clamp 102 and the hose when the at least a clamp 102 is in an engaged position. The high-friction material layer may be disposed on the interior surface of the closed ring. This layer may be adhered, bonded, co-molded, or mechanically retained to the base structure of the ring and may be configured to deform slightly under clamping pressure, thereby conforming to surface irregularities of the hose. The high-friction material layer may operate alone or in conjunction with other surface features such as knurling to resist slippage between the clamp and the hose when the clamp is in an engaged position. In further embodiments, the high-friction material layer may include multiple sub-layers, each configured to perform a specific function. For instance, a base layer may provide structural support and bonding compatibility with the at least a clamp 102 body, while an intermediate cushioning layer may be included to absorb shock or vibration during use. An outer friction-enhancing layer may be formulated with a high coefficient of friction and configured for direct contact with the exterior surface of the hose to resist slippage. The number of sub-layers may vary depending on design requirements; however, in some embodiments, the high-friction layer may include one to three distinct functional layers. In some cases, multiple high-friction inserts or lining segments may also be arranged circumferentially within the closed ring to permit modular replacement, facilitate wear tracking, or provide localized grip enhancement.

Still referring to FIG. 1, in an embodiment, the closed ring may include a plurality of circumferentially spaced mounting regions configured to receive and secure corresponding hand grips at different angular positions around the closed ring. For purposes of this disclosure, "circumferentially spaced" is a geometric arrangement in which multiple components, features, or structural elements are distributed around the circumference of a circular or arcuate structure. A "mounting region," for purposes of this disclosure, is a portion of a component that is configured to receive and secure an attachment. Each mounting region may include a mechanical interface, such as a threaded hole, molded recess, dovetail slot, or other structural feature, that engages with a mating portion of a handle grip 110. These mounting regions may be distributed evenly or unevenly around the circumference of the closed ring and may support different mounting configurations depending on operator needs or application requirements. In one configuration, the mounting regions may be used to enable a single handle grip to be selectively repositioned among the available angular positions. In this example, the handle grip 110 may be detached from one region and reattached to another without requiring removal of the clamp from the hose, allowing the user to adjust the handle's orientation based on the blasting angle, workspace constraints, or personal comfort. In another configuration, multiple handle grips 110 may be secured to separate mounting regions at the same time, providing enhanced two-handed control or permitting use by multiple operators. In some cases, only one handle grip 110 may include a trigger mechanism to avoid redundancy. Alternatively, and/or additionally, each handle grip 110 of the multiple handle grips 110 may include one or more aspects of the trigger mechanism. This simultaneous mounting arrangement may also serve to distribute load or stabilize the hose during overhead or precision blasting operations. In either configuration, the mounting regions may allow for ergonomic and task-specific customization of the handle assembly's position and functionality.

With further reference to FIG. 1, in an embodiment, the at least a clamp 102 may further include at least one shim insert configured to conform an interior diameter of the closed ring to different hose sizes. For purposes of this disclosure, a "shim insert" is a removable or interchangeable component configured to occupy space between two surfaces to adjust fit, alignment, or contact pressure. The shim insert may be positioned along the interior surface of the closed ring to reduce or otherwise modify the internal diameter of the at least a clamp 102 without requiring structural changes to the closed ring itself. In this manner, the shim insert may enable the handle assembly to accommodate hoses of varying outer diameters while maintaining sufficient clamping force and frictional engagement when the at least a clamp 102 is in an actuated position. The shim insert may be formed from a high-friction material, such as rubber, thermoplastic elastomer, or another compliant, wear-resistant substance, and may include a smooth or textured interface that contacts the exterior surface of the hose. In some embodiments, the shim insert may also include alignment features such as tabs, slots, or retention channels that engage corresponding features on the interior of the closed ring to ensure correct positioning during installation. In an embodiment, the shim insert may be continuous or segmented, and in certain cases, a plurality of shim inserts may be circumferentially arranged within the ring to provide partial or full coverage of the interior surface. In other embodiments, shim inserts of varying thicknesses or geometries may be provided as part of a kit to enable field configurability, such that an operator can select and install a shim insert that best conforms to the hose diameter in use. This shim-based approach may increase the versatility of the handle assembly and reduce the need for size-specific clamps or tools, allowing a single handle design to be deployed across a range of hose types and diameters commonly encountered in industrial blasting operations.

In further reference to FIG. 1, in an embodiment, the at least a clamp 102 may include an overcenter lever 104 configured to modify, either increasing or decreasing, the adjustable diameter of the closed ring to adjust an amount of friction between the at least a clamp 102 and the hose. For purposes of this disclosure, an "overcenter lever" is a mechanical actuation component configured to apply force to a linkage or structure by rotating through an arc and moving past a mechanical center point to achieve a stable, locked position. The overcenter lever 104 may be operatively connected to the structural body of the closed ring such that movement of the lever from a disengaged to an engaged position causes the ring to contract radially inward. This contraction may generate a circumferential clamping force that compresses the hose and resists axial and rotational movement of the handle assembly during use. When the lever passes beyond its center point during rotation, mechanical overcenter geometry may cause the overcenter lever 104 to resist reversal, allowing the clamp to remain engaged without continuous user input. The overcenter lever 104 may include an arm or handle portion, a pivot or hinge axis, and a mechanical interface such as a cam, linkage, or compression bracket. This configuration may enable high clamping forces to be applied and released using a compact and ergonomic manual input. In an embodiment, the overcenter lever 104 may be sized and shaped to allow for ergonomic, one-handed operation, and may be positioned to provide mechanical leverage such that a relatively small user input can produce a relatively large clamping force. For example, in some embodiments, the overcenter lever 104 may include a hinged arm extending outward from the body of the at least a clamp 102, where the distal end of the lever is shaped as a grip surface to receive manual pressure from a user's palm or thumb. When the lever is rotated toward the clamp body, the pivot point and linkage geometry may allow the user to generate clamping forces that exceed the applied input force by a mechanical advantage ratio, such as 4:1 or greater. In practical terms, a user may exert only moderate hand pressure—on the order of 10 to 15 pounds of force—while the resulting clamping force applied circumferentially to the hose using the closed ring may exceed 40 to 60 pounds. This mechanical leverage may be particularly useful in field environments where tool-less, quick-lock operation is desired, and may enable the at least a clamp 102 to be secured reliably even under conditions involving vibration, overhead use, or limited dexterity due to gloves or protective gear. In some embodiments, the geometry of the overcenter lever 104 may also provide tactile or audible feedback (e.g., a snap or resistance release) as it passes the center point, indicating full engagement.

In an embodiment, actuation of the overcenter lever 104 may fix the handle assembly 100 in place using frictional engagement. When the overcenter lever 104 is actuated to reduce the adjustable diameter of the closed ring, the interior surface of the at least a clamp 102 may engage the outer surface of the hose. This engagement may generate frictional resistance sufficient to counteract the forces associated with blasting operations, including reactive hose recoil, vibration, and gravitational loading. In the engaged position, the overcenter lever 104 may move past a mechanical center point and lock into a stable, overcentered state, thereby resisting inadvertent release due to shock or incidental contact. This reversible frictional locking mechanism may allow the handle assembly to be fixed in place during use and repositioned when the clamp is released.

With continued reference to FIG. 1, in an embodiment, the overcenter lever 104 may include a rotating knob mechanically coupled to the overcenter lever 104, the rotating knob configured to apply a rotational input that actuates the overcenter lever 104 to reduce the adjustable diameter of the closed ring. For purposes of this disclosure, a "rotating knob" is a control element configured to apply a torque input about a rotational axis. The rotating knob may interface with the overcenter lever 104 through a cam, threaded shaft, or other mechanical linkage that converts rotational motion into linear or pivotal movement of the lever. This configuration may allow for finer control over the clamping force applied to the hose and may facilitate incremental tightening or loosening of the at least a clamp 102. In some embodiments, the rotating knob may be contoured for manual operation, include tactile feedback such as detents, or be positioned to allow access without repositioning the user's grip on the handle assembly. For example, the rotating knob may include a contoured exterior surface, such as ridges, knurls, or recessed grips, to facilitate manual engagement and may be formed from plastic, metal, or other durable materials suited to repeated handling. In the context of the present disclosure, the rotating knob may be mechanically coupled to the overcenter lever 104 through a linkage, cam, or threaded interface such that rotation of the knob translates into movement of the lever, resulting in a reduction of the closed ring's adjustable diameter. In some embodiments, the rotating knob may be mounted coaxially with the overcenter lever's 104 pivot axis or positioned adjacent to the overcenter lever 104 in a location easily reached by the user's thumb or index finger when the handle grip 110 is held in a natural position. For example, the knob may be located directly above the grip or integrated into the side of the at least a clamp 102 body facing the operator, such that the user can rotate the knob without removing their hand from the handle or altering their operating stance. In one configuration, a pistol-style grip may allow the user to maintain a stable grasp of the handle while reaching the knob with the thumb of the same hand. In another example, the knob may be placed within reach of the non-dominant hand when the dominant hand remains fixed on the handle, enabling two-handed operation for more precise or forceful adjustment. This configuration may be particularly advantageous when fine-tuning clamp tightness during initial setup or when repositioning the handle assembly while wearing gloves or operating in confined spaces. The positioning and ergonomics of the rotating knob may also reduce the risk of accidental adjustment during blasting operations and may allow the at least a clamp 102 to be securely engaged or disengaged without requiring the operator to switch hands or shift body position.

Still referring to FIG. 1, in an embodiment, the at least a clamp 102 may include a security latch positioned adjacent to the overcenter lever 104 and configured to restrict movement of the overcenter lever 104. For purposes of this disclosure, a "security latch" is a movable locking component configured to selectively restrict or prevent the movement of another mechanism until the latch is released. The security latch may operate by physically obstructing the travel path of the overcenter lever 104 or by mechanically engaging with a portion of the lever to block its pivot or rotation. The security latch may include a movable locking feature such as a spring-biased catch, a sliding tab, or a hinged guard that obstructs the overcenter lever's 104 travel path or prevents rotation until the latch is intentionally moved. In some embodiments, the latch may be positioned for thumb actuation or integrated into the lever housing for single-hand operation. The security latch may be configured to reduce the risk of accidental disengagement caused by vibration, impact, or unintentional user contact. The inclusion of a security latch enhances the safety and reliability of the handle assembly by ensuring that the clamp remains locked until the user deliberately releases the latch and actuates the lever.

With further reference to FIG. 1, in an embodiment, the security latch may be implemented in a variety of configurations. In some embodiments, the security latch may include a spring-biased tab or flap that automatically defaults to a blocking position and must be manually pressed out of the way before the overcenter lever 104 can be actuated. In other embodiments, the latch may comprise a sliding pin that engages a recess on the lever arm to prevent rotation, or a rotating cam stop that obstructs lever movement when in a locked orientation. In certain use cases, a hinged safety flap may be mounted over or around the lever itself, preventing the user from gripping the lever unless the flap is first flipped open. These structural variations allow for different levels of mechanical security and may be selected based on the intended operating environment, required durability, or user interface preferences. Placement of the security latch may vary depending on the geometry of the at least a clamp 102 and handle assembly. In some embodiments, the security latch may be located on the proximal side of the overcenter lever 104, facing the user, and may be configured for thumb actuation, enabling single-handed operation during clamp engagement or release. In other embodiments, the security latch may be positioned laterally, above, or beneath the lever, requiring a two-step motion in which the latch must be lifted, rotated, or slid before the lever can be moved. The security latch may be integrated as part of the overcenter lever's 104 molded body or housed in a distinct assembly secured to the at least a clamp 102 structure using fasteners or embedded retention features. Regardless of configuration, the security latch may enhance operational safety by ensuring that the clamping mechanism remains locked until intentionally released by the operator.

In further reference to FIG. 1, it will be appreciated that various components of the handle assembly may be designed to facilitate ease of installation, removal, or repositioning in the field. In an embodiment, the at least a clamp 102 may further include a quick-release mechanism. In an embodiment, the quick-release mechanism may allow the handle assembly to be mounted to or removed from the hose without requiring the at least a clamp 102 to be slid over an open hose end. This may be particularly advantageous in scenarios where the hose is already connected to fittings, nozzles, or ancillary equipment, or where the user seeks to reposition the handle without disturbing other elements of the blasting setup. For purposes of this disclosure, a "quick-release mechanism" is a structural configuration that allows the at least a clamp 102 to be opened, positioned around a hose, and closed again without requiring full circumferential threading or disassembly of upstream or downstream hose components. The quick-release mechanism may enable rapid field attachment and detachment using manual input and may optionally be tool-less. This feature may enhance setup speed, reduce downtime during repositioning, and allow the operator to adapt the handle location to changing work angles or ergonomic requirements.

In continued reference to FIG. 1, in an embodiment, the quick-release mechanism may include at least two separable segments of the closed ring. For purposes of this disclosure, "separable segments" refers to two or more structural portions of a component that are configured to detach, pivot, or otherwise articulate relative to each other along a separation interface. For purposes of this disclosure, a "separation interface" is a defined boundary, joint, or region between two structural segments that allows the segments to move relative to one another or to be selectively connected and disconnected. The separation interface may enable a structure to transition between an open configuration, in which the segments are spaced apart or disengaged to allow access or clearance, and a closed configuration, in which the segments are joined to form a continuous or substantially continuous structure. In the context of the present disclosure, a separation interface may be formed by a variety of mechanical or geometric arrangements, including but not limited to: hinged interfaces, where the segments are connected by a pivoting axis that allows one segment to rotate relative to another, such as in a clamshell or swing-arm configuration; interlocking edges, in which mating profiles such as dovetails, tongue-and-groove structures, or keyed channels align and engage to ensure proper fit and load transfer when the ring is closed; removable fastener systems, including threaded bolts, cam locks, or quick-release latches that temporarily secure the segments together; snap-fit or detent interfaces, where a deformable feature on one segment fits into a receiving feature on the other and holds under tension or pressure; and magnetically assisted closures, in which embedded magnets or magnetic materials provide alignment and holding force without mechanical fasteners. In some embodiments, the separation interface may include alignment guides, locking pins, or compression fittings to ensure that when the segments are joined, they form a stable ring capable of transmitting circumferential clamping force. The location of the separation interface may vary depending on the ring geometry and may be diametrically opposite a hinge, concentrically offset, or distributed across multiple segments for modular reassembly.

With further reference to FIG. 1, in the context of the present disclosure, separable segments of the closed ring may be connected by a hinge, joint, or mechanical fastening interface and are capable of being moved apart or reconfigured to allow the ring to open and receive a media blast hose without requiring end-wise insertion. Separable segments may be fully detachable or may remain mechanically linked during operation using integrated features such as flexible joints, locking arms, or rotational pins. For purposes of this disclosure, "mechanically linked" refers to a physical connection between two or more components such that movement or force applied to one component causes a corresponding movement or effect in the other component(s). In mechanically linked configurations, the segments may remain physically connected throughout operation, enabling coordinated motion without requiring full disassembly. Examples may include a hinged interface allowing two segments of a clamp to pivot open and closed while remaining joined at the hinge, a flexible living joint integrally formed between adjacent segments, or a locking arm that rotates to secure two segments together while keeping them engaged at a pivot point. In contrast, detachable configurations may permit the segments to be fully separated from one another, such as by using a quick-release pin that can be withdrawn to disengage the segments, or a threaded fastener that, when removed, allows the ring to open completely. These detachable arrangements may facilitate reconfiguration or replacement of components but do not maintain a mechanical linkage during operation.

When rejoined, the segments may form a continuous or substantially continuous loop that provides uniform clamping force. "Continuous," for purposes of this disclosure, refers to a structural form that is unbroken, uninterrupted, and fully enclosed around a central axis or object. A continuous closed ring, in this context, may define a circular or non-circular loop with no separation or articulable sections, such that the internal geometry of the ring remains fixed and closed in all directions. A continuous configuration may provide uniform circumferential clamping force and may be formed from a single piece of material or a molded body without break lines or hinges. Alternatively, "substantially continuous," for purposes of this disclosure, refers to a structure that, while composed of multiple segments or including minor gaps, discontinuities, or articulations, performs functionally as a continuous structure when in the engaged or assembled position. In the case of a segmented closed ring, a substantially continuous form may include one or more separable or hinged portions joined by a mechanical fastening interface. When the fastening interface is secured, the resulting structure transmits clamping force circumferentially and uniformly enough to emulate the behavior of a fully continuous ring. This definition allows for, without limitation, hinged or latched rings that achieve the functional equivalent of uninterrupted engagement around the hose when actuated. The segmentation of the ring may allow for easier installation around hoses that are already in place or for more compact storage and transportation of the handle assembly.

In an embodiment, the quick-release mechanism may include a mechanical fastening interface configured to mechanically connect the at least two separable segments of the closed ring, wherein the two separable segments are configured to encircle the media blast hose. For purposes of this disclosure, a "mechanical fastening interface" is a structural assembly or connection feature configured to physically join two or more components using mechanical engagement. The mechanical fastening interface may include one or more structural elements such as a latch, snap-fit joint, cam lock, hinged clasp, threaded coupling, and/or other locking mechanisms configured to draw the ring segments together and maintain structural integrity under clamping load. In some embodiments, the fastening interface may also incorporate alignment features, such as interlocking tabs, keyed surfaces, or embedded pins, that ensure proper reassembly and load distribution. The fastening interface may be positioned opposite a hinge in a clamshell configuration or may be symmetrically distributed for modular ring segments. In either case, the mechanical fastening interface may allow the at least a clamp 102 to function as a closed ring when engaged, while providing the flexibility of an openable, serviceable, or interchangeable ring structure when disengaged. For purposes of this disclosure, "mechanically connected" refers to a structural relationship between two or more components in which force, motion, or mechanical energy can be transmitted directly between the components through physical contact or an intermediate linkage. This connection may be fixed, movable, or articulated, and may include any configuration where components are joined in a manner that permits coordinated mechanical function, whether by direct attachment (e.g., fasteners, welds) or indirect coupling (e.g., hinges, pins, joints, or linkage arms). A mechanically connected arrangement may exclude purely electrical, optical, or wireless coupling unless such systems are housed within or supported by a mechanical structure that transmits physical force or motion.

With continued reference to FIG. 1, in an embodiment, the at least a clamp 102 may include a first clamp and a second clamp. The use of multiple clamps along the length of a media blast hose may provide enhanced stability, ergonomic control, or modular functionality. In an embodiment, the first clamp may be affixed to the hose at a first position. In an embodiment, the second clamp may be affixed to the hose at a second position spaced apart from the first clamp. In other words, the second position may differ from the first position. For example, the second position may be longitudinally spaced along the hose from the first position, such that the two clamps are secured at different points along the length of the hose to provide distributed stability or to secure different components, such as a handle and a control line. Alternatively, the second clamp may be affixed to a different circumferential region of the hose (e.g., offset by 90 degrees around the outer diameter of the hose) such that each clamp engages a different radial orientation. In certain embodiments, the first clamp may be near the proximal end of the handle assembly, while the second clamp may be spaced several inches distally to provide dual-point attachment. The spacing may range from approximately 1 to 12 inches depending on the application and desired rigidity of the mount. In the context of clamp spacing, "approximately" encompasses variations of ±0.5 to ±2 inches from a given value, such that the spacing continues to provide stable, ergonomic, and effective positioning for the handle assembly or supported components. In an embodiment, the distance between the first clamp and the second clamp may be fixed or adjustable depending on the needs of the user or the geometry of the blasting task. For example, a first clamp may secure a primary handle grip 110 near the operator's dominant hand, while a second clamp may anchor a secondary grip for the non-dominant hand, enabling two-handed control and reducing user fatigue during extended or precision operations. In other embodiments, the second clamp may support routing or stabilization of attached components such as control lines, blast hose jackets, or accessory mounts. The inclusion of multiple clamps may also distribute mechanical loads more evenly across the hose, minimizing wear or deformation at a single clamping point and improving durability under dynamic conditions.

In continued reference to FIG. 1, in an embodiment, the first clamp and the second clamp may be mechanically linked by a control line management system configured to maintain an alignment during repositioning. For purposes of this disclosure, a "control line management system" is a structural assembly or routing mechanism that maintains the spatial relationship of one or more control lines between multiple clamp locations along the hose. The system may include flexible guides, retention clips, tensioning elements, or integrated cable channels configured to prevent entanglement, slack, or stress concentration as the handle assembly is repositioned. In some embodiments, the control line management system may include a segmented conduit or braided sheath that spans between the first and second clamps, maintaining a defined length and routing path. This configuration may ensure that the control lines remain securely fastened, aligned with the axis of the hose, and protected from abrasion or kinking during use. The linkage may also facilitate coordinated movement of both clamps during linear or rotational repositioning, enabling the user to adjust the handle assembly as a unified system without disturbing the control interface or requiring separate adjustments at each clamping point. In an embodiment, "maintaining an alignment during repositioning" as described in this disclosure refers to the ability of the system to preserve the relative orientation and spacing of the first and second clamps, as well as the control lines routed between them, while the handle assembly is moved along or rotated about the media blast hose. For example, during linear repositioning, such as sliding the handle assembly along the hose, the control line management system may constrain the clamps to move in parallel or along the same axial plane, preventing skew or twisting. During rotational repositioning, system may maintain circumferential alignment so that both clamps rotate together as a unit around the hose, preserving the intended routing angle of the control lines. This ensures that the control lines remain properly tensioned and guided without introducing torsion, tangling, or misalignment that could impair control functionality or introduce mechanical strain. The linkage may also reduce the need for individual adjustment of each clamp by enabling synchronized movement, thereby enhancing ergonomic use and system reliability.

In further reference to FIG. 1, in an embodiment, handle assembly 100 comprises a handle grip 110. For purposes of this disclosure, a "handle grip" is a structural component configured to serve as a user interface for holding, guiding, and manipulating a media blast hose or an associated assembly. The handle grip 110 may serve as the primary interface between the user and the media blast hose, providing a secure and controllable surface for manipulating the position and orientation of the hose during abrasive blasting operations. The handle grip 110 may be positioned along the hose using the at least a clamp 102 and may be configured to accommodate a variety of operational preferences, including one-handed or two-handed use, overhead or lateral spraying angles, and static or dynamic positioning. In some embodiments, the handle grip 110 may be shaped as a pistol grip, straight grip, or contoured body, and may include integrated features such as a trigger mechanism, safety switch 108, or control line connection to facilitate operation of the media blast system. The handle grip 110 may be fixed or removably connected to the at least a clamp 102 and may be repositionable around the circumference of the hose to accommodate operator preference or task-specific requirements. For purposes of this disclosure, "removably connected" refers to a configuration in which two or more components are physically joined in a manner that allows for intentional separation without damaging either component and without requiring permanent alteration or destruction of the connection interface. The connection may be secure during normal operation but may be designed to be disengaged or re-engaged by a user, in some cases using manual force or common tools. A removably connected arrangement may include mechanical fasteners, snap-fit interfaces, quick-release mechanisms, or other non-permanent joining structures that allow for reattachment after separation.

With further reference to FIG. 1, in an embodiment, the handle grip 110 may include an ergonomic pistol grip handle. In an embodiment, the handle grip 110 may be "ergonomic" in the sense that the handle grip 110 includes a pistol grip handle contoured to support a user's palm and fingers in a neutral wrist position and is configured to permit single-handed actuation of the overcenter lever 104. For purposes of this disclosure, a "pistol grip handle" is a downward-extending grip structure configured to be grasped in the manner of a pistol, where the palm of the hand wraps around the grip body and the fingers naturally align with a forward-facing trigger surface. In an embodiment, the ergonomic pistol grip handle may be contoured to fit the natural curvature of a user's hand and may include surface treatments such as texturing, finger grooves, or overmolded padding to improve comfort and grip stability. This configuration may be particularly advantageous in applications requiring fine directional control or prolonged use, as it can reduce wrist strain, distribute reactive hose forces more effectively, and support intuitive access to integrated controls. In some embodiments, the angle or length of the pistol grip may be adjustable or replaceable to accommodate different user preferences or glove thicknesses. For example, the ergonomic pistol grip may be connected to the handle assembly by a rotational joint or slotted bracket that permits the angle of the grip relative to the hose axis to be adjusted and locked into position using a detent, set screw, or cam lever. This may allow the grip to be oriented more vertically for overhead work or more forward-leaning for lateral surface blasting. In other embodiments, the grip may be removably connected using a dovetail rail, keyed flange, or modular mounting block, allowing the user to swap between grips of different lengths, thicknesses, or contour profiles. A longer grip may provide enhanced leverage for two-handed operation, while a shorter or thinner grip may be preferable in tight workspaces or for operators with smaller hands. These variations may be implemented using interchangeable components or a multi-position adjustment mechanism, enabling customization of the handle assembly to suit ergonomic needs and task-specific requirements.

Still referring to FIG. 1, in an embodiment, the handle grip 110 may be removably connected to the at least a clamp 102 by a mechanical fastening interface. In an embodiment, the removable connection may allow the handle grip 110 to be detached for servicing, cleaning, replacement, or reconfiguration without disassembling the entire clamp assembly. In some embodiments, the mechanical fastening interface may be configured to allow the handle grip 110 to be repositioned along the circumference of the closed ring, enabling angular adjustment of the grip's orientation relative to the hose. This modularity may support the use of multiple handle types or accessories and allow the operator to tailor the system for specific tasks or ergonomic requirements.

In continued reference to FIG. 1, in an embodiment, the handle grip 110 may further include a trigger mechanism. For purposes of this disclosure, a "trigger mechanism" is a user-actuated assembly configured to initiate or control an operational function of the media blast hose through direct or indirect manual input. The trigger mechanism may serve as the primary control interface between the user and the actuation system and may be integrated within or adjacent to the handle grip 110. In some embodiments, the trigger mechanism may include one or more components such as a trigger 112, a safety switch 108, a control connection 106, or a signal interface, and may be configured to actuate a pneumatic, hydraulic, or electrical control system. The trigger mechanism may be ergonomically positioned to allow intuitive activation using a natural hand motion, such as squeezing or pressing, while the operator maintains a stable grasp on the handle. For purposes of this disclosure, "ergonomically positioned" refers to the placement or arrangement of a component in a way that aligns with natural human body mechanics to promote comfort, reduce strain, and enhance ease of use during operation. In certain embodiments, the trigger mechanism may incorporate a return spring, detent, or damping feature to regulate actuation travel and ensure consistent feedback during operation. The configuration of the trigger mechanism may be adapted to accommodate gloved use, overhead blasting angles, or prolonged operation in industrial environments.

In further reference to FIG. 1, in an embodiment, the trigger mechanism may include a safety switch 108 positioned adjacent to the trigger 112. In an embodiment, the safety switch 108 may include a blocking element configured to physically obstruct movement of the trigger 112 until the safety switch 108 is manually disengaged. For purposes of this disclosure, a "safety switch" is a mechanical or electromechanical locking element that must be displaced before the trigger can be actuated. The safety switch 108 may operate as a rotating lever, sliding gate, or hinged flap positioned adjacent to the trigger 112, and may include structural features designed to block or lock the trigger 112 in a neutral position until the switch is moved. For purposes of this disclosure, a "blocking element" is a structural component of the safety switch 108 that is physically interposed between the trigger 112 and its actuation path, such that the trigger 112 cannot be depressed or rotated without first removing or displacing the blocking element. The blocking element may take the form of a tab, lever arm, gate, cam surface, or mechanical stop that directly engages the body or travel path of the trigger 112. In some embodiments, the blocking element may be spring-loaded or biased toward a default obstructing position, and may require deliberate displacement, such as pressing, sliding, lifting, or rotating, to allow trigger 112 to move. The blocking element may provide a tactile or audible indication (e.g., a click or snap) when disengaged, and may be designed to automatically return to a blocking position when released or remain in a disengaged position until manually reset. In an embodiment, the safety switch 108 may be required to be manually displaced by the user to transition the trigger mechanism from a locked to an unlocked state. In an embodiment, the actuation may require a deliberate physical movement, such as pressing, sliding, lifting, or rotating the switch using a finger, thumb, or palm, prior to permitting engagement of trigger 112. In an embodiment, the safety switch 108 may be rotatable and configured to pivot through an arc of motion within a range of approximately 15 to 30 degrees before releasing the trigger 112. For purposes of this disclosure, an "arc of motion" is the angular travel path of a rotating component measured between its resting (locked) position and its fully disengaged (unlocked) position. In some embodiments, alternative arc of motion ranges may be employed depending on user preference or safety requirements, including but not limited to angular displacements of approximately 10 to 20 degrees, 20 to 45 degrees, or 30 to 60 degrees, depending on the level of mechanical resistance, spring bias, or required tactile confirmation. For purposes of this disclosure, "approximately" refers to a range of values that may deviate from a stated numerical value or range by a margin that does not materially affect the function, purpose, or safety performance of the component. In the context of angular displacement, "approximately" encompasses variations of ±2 to ±5 degrees, unless otherwise indicated, such that the safety switch continues to require deliberate user action to unlock the trigger while preventing accidental actuation. This angular displacement requirement may prevent accidental actuation due to incidental contact, vibration, or hose movement, and may ensure that the user must deliberately engage the system. The safety switch 108 may also be configured to resist actuation under low-force conditions, requiring a defined threshold of torque or finger pressure to complete its arc of motion. The arc of motion may be guided by detents, tension springs, or predefined travel limits, and may be configured to provide tactile or audible feedback, such as a click or snap, to signal when the trigger 112 has been released for actuation. In certain embodiments, the safety switch 108 may return automatically to the locked position when released or may remain in an unlocked state until manually reset.

With continued reference to FIG. 1, in an embodiment, the trigger mechanism may include a trigger 112 operably connected to the safety switch 108. For purposes of this disclosure, a "trigger" is a user-actuated control element configured to initiate a functional response within the handle assembly or its associated control system when manually engaged. The trigger 112 may be a spring-biased or freely pivoting control member positioned to receive direct manual input from the operator. Upon engagement, the trigger 112 may initiate a signal, valve actuation, or control line displacement, thereby changing the operating state of the media blast hose—for example, by opening or closing a pneumatic control line, actuating a twin-line signal circuit, or transmitting an electrical command to a remote valve. In some embodiments, the trigger 112 may be mechanically linked to an internal plunger, rocker arm, or cam mechanism that translates user motion into actuation force. The trigger 112 may be configured to return to a neutral or disengaged position after release via an integrated return spring, torsional hinge, or magnetic repulsion system, thereby reducing the likelihood of unintended prolonged activation. In further embodiments, the trigger 112 may be coupled to an internal linkage or control interface, such that its travel distance, actuation angle, and required input force are optimized for user comfort and operational safety. For example, a shorter travel distance with a defined resistance curve may improve responsiveness while reducing fatigue. The trigger surface may be contoured, textured, or coated with a high-friction or resilient material—such as thermoplastic elastomer (TPE), silicone overmold, or ribbed rubber inserts—to ensure slip-resistant actuation, particularly in environments where gloves are worn or the operator's hands may be wet, dusty, or contaminated with abrasive material. In some embodiments, the trigger 112 may further include features such as force-distribution flanges, guard rails, or anti-fatigue reliefs to improve grip, prevent pressure points, and allow for extended-duration use. The geometry of the trigger 112 may also be adapted to support multi-directional actuation or ergonomic asymmetry to accommodate left- or right-handed operation, or task-specific blasting angles. These refinements may contribute to greater operator control, reduce strain-related errors, and support consistent performance during repeated or high-pressure use cycles. For purposes of this disclosure, "operably connected" refers to a relationship between two or more components in which the components are functionally linked such that the operation of one affects, enables, or controls the operation of the other, either directly or indirectly. This connection may be mechanical, electrical, pneumatic, hydraulic, or software-based, and may involve intermediate components, so long as the functional relationship between the components is maintained during normal operation of the system.

In continued reference to FIG. 1, in an embodiment, the trigger mechanism may include a control connection 106 situated within the handle assembly 100 and operably connected to both safety switch 108 and trigger 112. For purposes of this disclosure, a "control connection" is a structural or functional linkage between the trigger mechanism and the system and is responsible for regulating the operating state of the media blast hose. In an embodiment, the control connection 106 may be configured to control an operating state of the media blast hose in response to activation of the safety switch 108 when the trigger 112 is engaged. In some embodiments, the control connection 106 may comprise a twin-line pneumatic routing system, wherein two flexible pneumatic lines extend from the handle assembly to a remotely located control valve or actuator. One pneumatic line may serve as a pressurization or signal line, while the second line functions as an exhaust or return path. When the trigger 112 is engaged, a valve or plunger within the handle assembly may open or redirect airflow through the twin-line system, thereby actuating a downstream blast valve to begin or continue the flow of abrasive media. The twin-line system may be chosen for its responsiveness, mechanical simplicity, and compatibility with rugged industrial environments, especially where electronic controls may be undesirable or hazardous. The control connection 106 may be routed internally through the handle grip 110 and at least a clamp 102 to prevent entanglement or external snagging. In some configurations, the twin-line system may include check valves or flow restrictors to modulate the speed of actuation or prevent backflow under pressure fluctuations. In certain embodiments, once the trigger mechanism is initially actuated by the user, by using compression of the trigger 112 through the thenar web or index finger, the system may enter a state in which the pressure of the outgoing media or the reactive force of the flowing material contributes to continued actuation of the trigger 112. For example, the weight and tension of the media blast hose in combination with pressurized recoil may apply a sustained force in a direction that maintains the trigger 112 in a depressed position. This may reduce the user's need to maintain constant finger pressure during prolonged blasting operations and may contribute to ergonomic efficiency and operator endurance. In such cases, system may rely on a passive hold-in-force generated by the hose dynamics or may include an optional mechanical over-center linkage or magnetic detent to assist in maintaining the engaged state until intentionally disengaged.

In continued reference to FIG. 1, in some embodiments, the handle grip 110 may include one or more safety features configured to automatically interrupt operation in the absence of sustained user input. For example, the trigger mechanism may include a pressure-sensitive switch, force-detecting membrane, or mechanical contact sensor configured to detect continuous engagement by the operator's hand or fingers. If the system determines that user input has been removed, such as if the handle is dropped or the operator loses grip, an internal cutoff valve or electronic shutoff relay may be triggered to immediately close the control connection 106 or exhaust pressure from the actuation line. This failsafe mechanism may operate independently of the trigger's 112 physical position, ensuring that blasting ceases even if the trigger 112 remains mechanically depressed due to hose weight, debris, or obstruction. In certain implementations, the pressure-detection system may be calibrated to ignore momentary fluctuations while still responding to sustained disengagement, providing a balance between operational continuity and safety. In addition to operator-detection features, system may also be configured to enter a fail-safe mode automatically upon detection of a system failure or pressure loss within the control lines. For example, the twin-line pneumatic control system may include pressure sensors, rupture discs, or check valves that trigger 112 immediate shutoff of media flow if expected pressures are not maintained. The system may implement basic control logic in which pressure thresholds or signal continuity must be satisfied for continued operation; if pressure in the signal line drops below a preset threshold for a defined duration, a cutoff valve may be actuated, or the exhaust path opened to vent downstream pressure. This passive safety response may enhance protection in case of hose rupture, disconnection, or sudden equipment malfunction, and may operate in conjunction with or independently of operator-input fail safes. This configuration may be particularly useful in industrial environments where the risk of accidental discharge must be minimized and where prolonged fatigue or distraction may increase the chance of unintentional actuation. Such safety mechanisms may also help the system comply with occupational safety standards requiring automatic shutoff in the event of operator incapacitation or unexpected interruption.

Still referring to FIG. 1, in an embodiment, the trigger mechanism is positioned so that, when the handle grip 110 is held in an operating position, the trigger mechanism aligns with and is actuated by a thenar web region between a user's thumb and index finger. For purposes of this disclosure, an "operating position" is the natural hand orientation in which an operator grips the handle grip 110, such that the palm faces toward a work surface and the fingers wrap around the grip in a stable, ready-to-use posture. This position may correspond to a wrist-neutral configuration that minimizes strain and allows for rapid and sustained control during media blasting operations. For purposes of this disclosure, and specifically in the present context, "aligns" refers to a spatial configuration in which the trigger mechanism is positioned such that it is substantially in contact with, or immediately adjacent to, the thenar web region of the user's hand when the handle grip is held in the operating position. This means that the actuation surface of trigger 112 may be oriented and located to receive compressive force directly from the fleshy web space between the base of the user's thumb and index finger, without requiring significant repositioning or finger articulation. In this aligned configuration, trigger 112 may be operable by natural pinching or squeezing motions of the thenar web, enabling low-force activation and minimizing ergonomic strain. Alignment may include vertical, angular, or lateral conformity between the trigger surface and the curvature or location of the thenar web region, such that mechanical engagement occurs through gross motor movement rather than fine dexterity. For purposes of this disclosure, a "thenar web" is the fleshy area of the hand located between the base of the thumb and the base of the index finger. This region is capable of exerting significant compressive force through a natural pinching or clamping motion without requiring fine motor engagement of individual fingers. In an embodiment, to support actuation by the thenar web, the trigger mechanism may be positioned on a proximal side of the handle grip 110 relative to a user and may be oriented in a direction aligned with the gravitational force vector of the hose during operation. In such a configuration, the weight of the hose may contribute to actuation of the trigger 112 and reduce the force required by the user. This geometry may be particularly advantageous in downward or angled blasting operations, where gravitational force aids displacement of trigger 112. By aligning the actuation axis with the natural direction of hose loading, system may minimize required finger or thumb force, further enhancing ergonomic performance and control accuracy during repetitive use. In some embodiments, the trigger 112 may be mounted at an angle of approximately 30 to 60 degrees relative to the longitudinal axis of the handle grip 110, such that when the handle is grasped in a natural posture, the base of the thumb and index finger rest adjacent to the trigger's 112 contact surface. The trigger 112 may be shaped with a broad, shallow activation surface that extends partially into the web space, allowing for contact over a wider area and reducing the need for precision placement. In some embodiments, the trigger 112 may include a curved, paddle-like or contoured flange aligned to the web's contour and may be spring-loaded or lightly biased to permit activation through low-force pinching or pressing motions. The surrounding portion of the grip may be recessed or flared outward to provide clearance and promote comfort during sustained use.

In further reference to FIG. 1, this positioning may allow the operator to activate the trigger 112 using a pinching or squeezing motion with the base of the thumb and index finger, thereby enabling intuitive control without requiring repositioning of the hand. By leveraging strong and naturally aligned muscle groups in the hand and wrist, the thenar-actuated configuration may enhance stability and reduce fatigue, particularly during extended use. Compared to conventional fingertip-operated triggers, this design may also improve blast control in conditions where glove use, debris, or vibration limit precision. Additionally, this configuration may improve blast control in conditions where glove use, debris exposure, or vibration would otherwise interfere with fingertip dexterity. In some embodiments, the actuation threshold and travel distance of the trigger 112 may be tuned specifically for thenar engagement, supporting both deliberate short bursts and sustained activation without excess strain.

Figure 2:
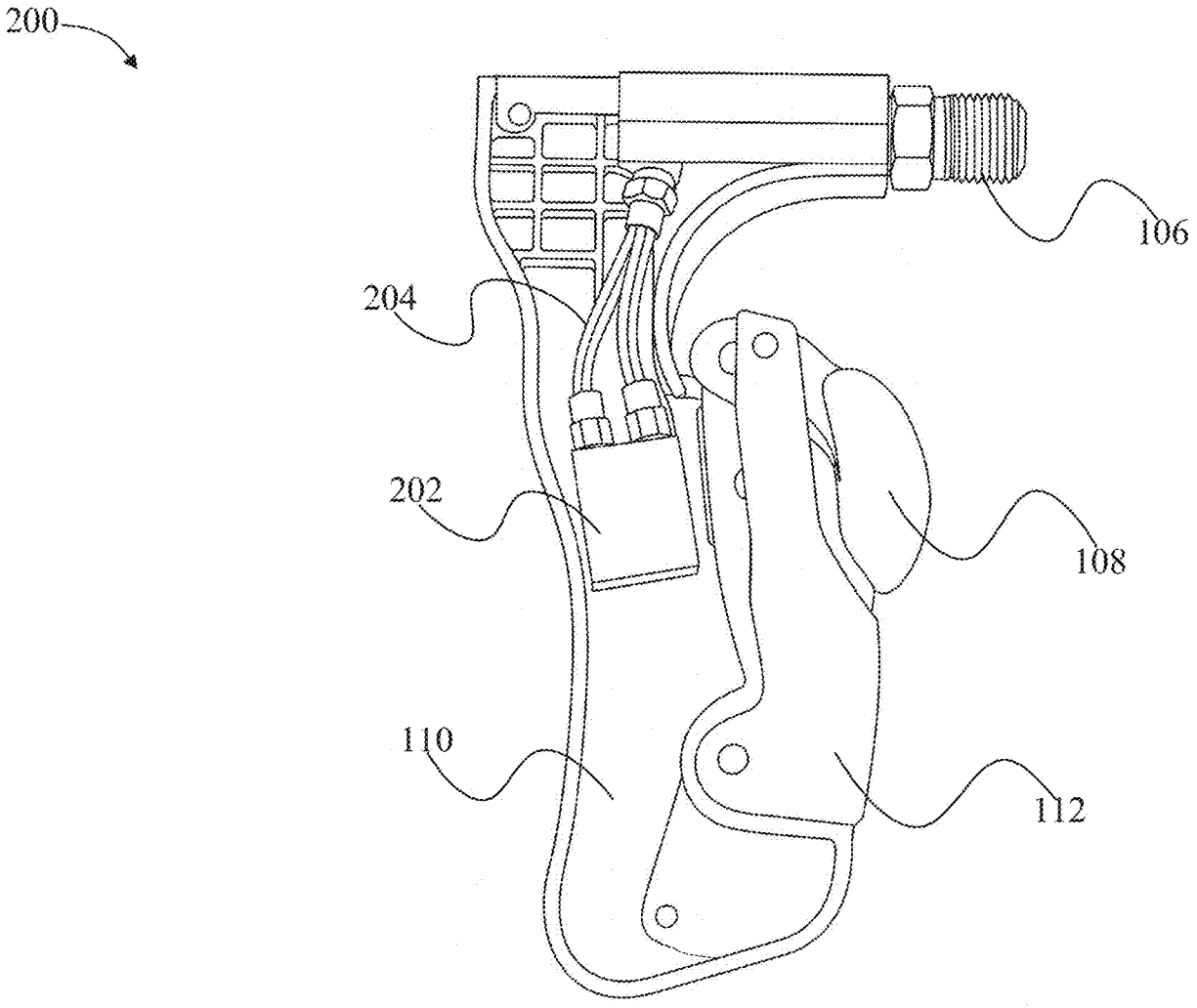
FIG. 2 illustrates an exemplary trigger switch assembly for a media blast hose.

Referring now to FIG. 2, an isometric view of a trigger switch assembly 200 for a media blast hose is illustrated. In an embodiment, the trigger switch assembly 200 may include a twin-line control connection 106 routed into the housing of the assembly to operatively couple the trigger mechanism to a remote valve. The twin-line control connection 106 may be configured to transmit pneumatic signals through separate pressurization and exhaust lines, thereby enabling responsive actuation of the media blast hose system. Within the trigger switch assembly 200, one or more internal components may be housed, including an activation component 202 and signal or media routing connections 204. In some embodiments, activation component 202 may include a manually-actuated trigger interface, such as a plunger, cam, or valve linkage, configured to redirect airflow within the twin-line circuit. Connections 204 may include structural tubing, ports, or fittings configured to direct pressurized signals or return flow to and from the handle assembly.

In continued reference to FIG. 2, an external safety switch 108 may be positioned on the housing of the trigger switch assembly 200 and may be configured to mechanically block activation of the trigger until manually displaced. In some embodiments, the safety switch 108 may pivot through an arc of motion to unlock the trigger, as described with reference to FIG. 1. The safety switch 108 may be ergonomically located for thumb actuation when the operator grasps the handle grip 110. In an embodiment the handle grip 110 may include an ergonomic pistol grip structure designed to promote user comfort during extended blasting operations. In one embodiment, the grip may include surface features such as finger grooves, textured panels, or vibration-damping overmold to reduce strain and enhance control. The handle grip 110 may be operatively connected to the trigger 112 and oriented such that the user can engage the trigger using the thenar web between the thumb and index finger.

With further reference to FIG. 2, in some configurations, the trigger mechanism may be biased to return to a disengaged position unless sustained user input is applied. This may be facilitated by a spring, torsion bar, or magnetic detent internal to the assembly. The arrangement of the safety switch 108, handle grip 110, and trigger 112 may enable a natural and intuitive hand posture, minimizing operator fatigue and risk of musculoskeletal injury. Further, in some cases, the trigger mechanism may also be oriented in a manner that allows the weight of the media blast hose and the geometry of the handle to assist with actuation. For example, in a downward-facing operational configuration, gravitational loading and hose recoil may bias the trigger into a partially actuated position, thereby reducing the operator's required force input. In operation, actuation of the trigger may cause the twin-line control connection 106 to transmit a pressure signal to a remotely located valve, opening the media blast flow path. The ergonomic arrangement and dual-control features may enable the operator to quickly and safely start or stop blasting with minimal repositioning.

Figure 3:
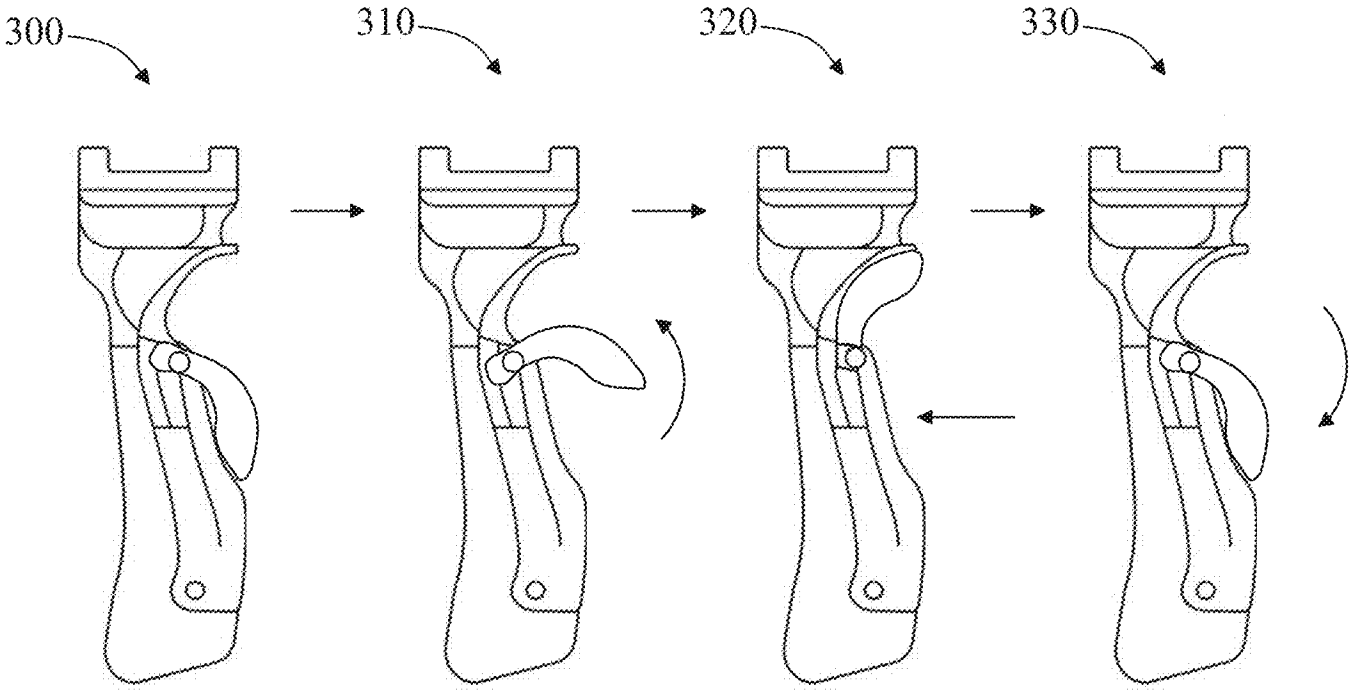
FIG. 3 presents multiple orthogonal views of a handle mechanism for a media blast trigger/switch in various states of operation.

Referring now to FIG. 3, multiple orthogonal views of a handle mechanism for a media blast trigger/switch in various states of operation are illustrated. In one view, the handle mechanism is depicted in a disarmed state 300, wherein the safety switch is in its resting position and the trigger is blocked from actuation. A second view illustrates the handle mechanism in an arming state 310, in which the safety switch has been lifted or rotated through an arc of motion to permit subsequent trigger actuation. A third view shows the handle mechanism in an activated state 320, where the trigger has been engaged to initiate media blast flow. A final view presents the handle mechanism in a disarmed post-activation state 330, where the trigger is no longer engaged and the system has returned to a safe condition. In each representation within FIG. 3, directional arrows may indicate the movement path of the safety switch and trigger components throughout the arming and activation process.

With further reference to FIG. 3, in some embodiments, the safety switch 108 may be mechanically configured to obstruct the motion of the trigger 112 until the safety switch has traveled through a predefined arc of motion. For purposes of this disclosure, the arc of motion may range from approximately 15 to 30 degrees, and in one example, may require a displacement of at least 20 degrees before the trigger is unblocked. This operational constraint enhances safety by reducing the likelihood of inadvertent actuation due to incidental contact, vibration, or unintentional operator input. The angular displacement may be defined by mechanical detents, stop features, or spring-loaded resistance integrated into the hinge or pivot axis of the safety switch. In some aspects, the safety switch 108 may be integrated directly into the body of the handle grip 110. This integration may allow for compact packaging of the arming mechanism and may be particularly advantageous in applications requiring single-handed operation. The safety switch 108 may be ergonomically positioned for thumb actuation while the operator maintains a stable grip, enabling a seamless transition from arming to firing without repositioning the hand. This configuration may reduce complexity, improve operator efficiency, and lower the risk of fatigue during extended use.

In further reference to FIG. 3, in some embodiments, the safety switch 108 may further serve as part of a fail-to-safe mechanism, in which the trigger 112 remains mechanically locked until a deliberate angular displacement of the safety switch has been completed. For example, the safety switch may be configured to engage a locking tab or detent that physically obstructs trigger travel until released. Upon rotation of the safety switch through the required arc, the locking element disengages, permitting free movement of the trigger. This arrangement may be used to satisfy regulatory or operational safety requirements while preserving ergonomic utility.

As shown in FIG. 3, the transition from the disarmed state 300 to the armed and activated states 310 and 320, respectively, may require a sequential and deliberate set of motions. This staged mechanism may reduce the risk of inadvertent operation while still allowing for rapid and intuitive control when necessary. Following actuation, the handle mechanism may return to a disarmed post-activation state 330 either through user input or using spring-return elements embedded in the safety switch or trigger assembly. This return-to-safe configuration ensures that the system defaults to a non-activating state when released or not in use.

Figure 4B:
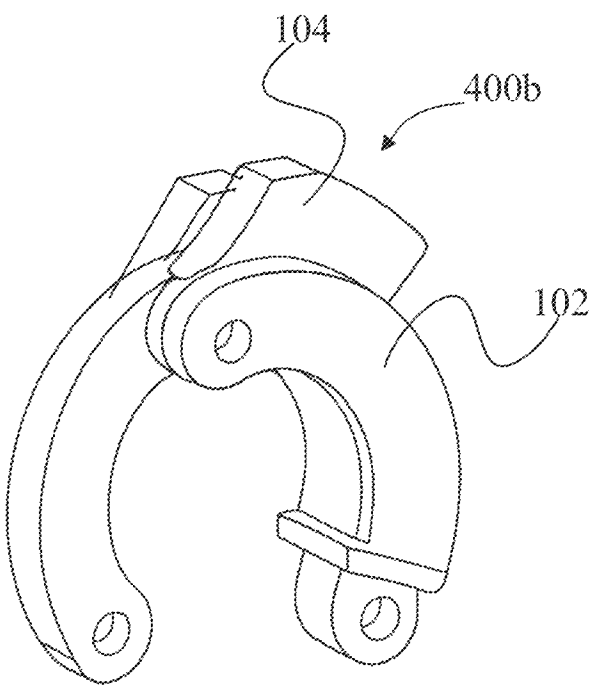
FIGS. 4A and 4B illustrate an isometric view of a handle mechanism for a media blast hose with the clamp in disengaged and engaged states respectively.
Figure 4A:
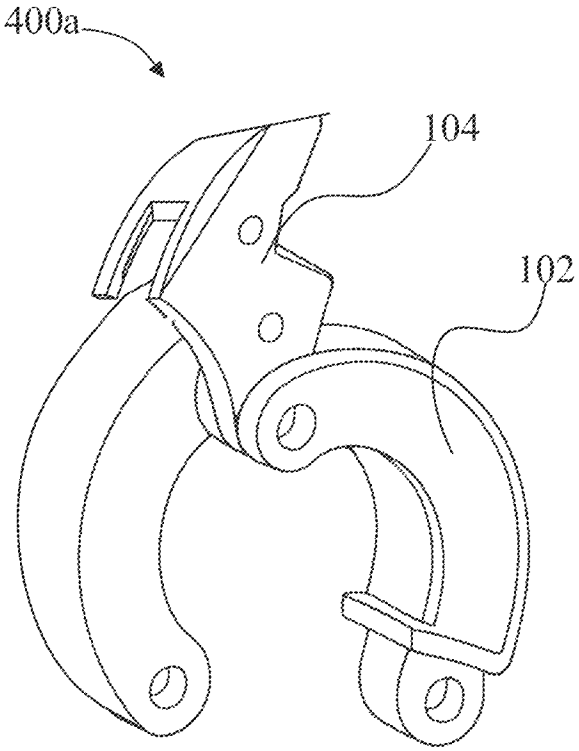

Referring now to FIGS. 4A and 4B, an isometric view of a handle mechanism for a media blast hose is depicted. FIG. 4A illustrates a first configuration 400*a* of a handle mechanism for a media blast hose, the clamp 102 is shown in a disengaged state, indicating that it is not clamped onto a hose. FIG. 4B illustrates a second configuration 400*b*, the clamp 102 is shown in an engaged state, suggesting that it is securely fastened to a hose. The clamp 102 and overcenter lever 104 work together to provide an ergonomic and secure interface that can be rapidly adjusted and engaged by the operator to modify the position or fixation of the trigger switch assembly. In some respects, the clamp 102 may include a closed ring having an adjustable diameter controlled by an overcenter lever. This configuration may allow for rapid attachment and detachment of the clamp 102 to a media blast hose without requiring end-wise insertion. The closed ring may be internally structured to achieve high-friction engagement with the hose through the use of knurling, high-friction linings, or compliant materials such as rubber or thermoplastic elastomers. These friction-enhancing features may help maintain the position of the handle assembly during dynamic operation and resist slippage under reactive forces.

In further reference to FIGS. 4A and 4B, the position of the trigger switch assembly on the media blast hose may be adjustable by actuating the overcenter lever to expand the internal diameter of the closed ring, repositioning the assembly along the hose, and re-engaging the lever to restore frictional fixation. This design may accommodate different operator preferences, blasting angles, or work surface orientations. The ability to quickly reposition the handle assembly may reduce operator fatigue and improve fine control during prolonged use. In further embodiments, the clamp 102 may include an integrated overcenter lever actuation interface such as a rotating knob. The rotating knob may apply a torque input that actuates the lever, improving ergonomics and reducing the risk of accidental release. The knob may include surface features such as ridges or detents to provide tactile feedback and ensure intentional operation. The placement of the rotating knob may allow it to be accessed with the same hand that grips the handle, supporting one-handed adjustments and improving user efficiency.

With continued reference to FIGS. 4A and 4B, in some embodiments, the clamp 102 may be structured with modular adaptability to accommodate different hose diameters. For example, the internal surface of the clamp 102 may be configured to receive interchangeable shim inserts that conform the internal diameter of the clamp to various hose profiles. These shim inserts may be formed from friction-enhancing materials and may be provided in multiple thicknesses to allow field selection. The shims may attach using molded grooves, snaps, or adhesive retention layers to facilitate easy replacement and minimize downtime. In additional embodiments, a single clamp 102 may be configured to support multiple handle grips. Multiple mounting regions may be circumferentially spaced around the clamp body to permit one or more grips to be attached simultaneously or repositioned as needed. This multi-handle configuration may support two-handed operation, asymmetric control, or alternate grip angles based on user preference or task-specific needs. It may also provide redundancy in control points to maintain hose stability in harsh or overhead conditions.

Figure 5B:
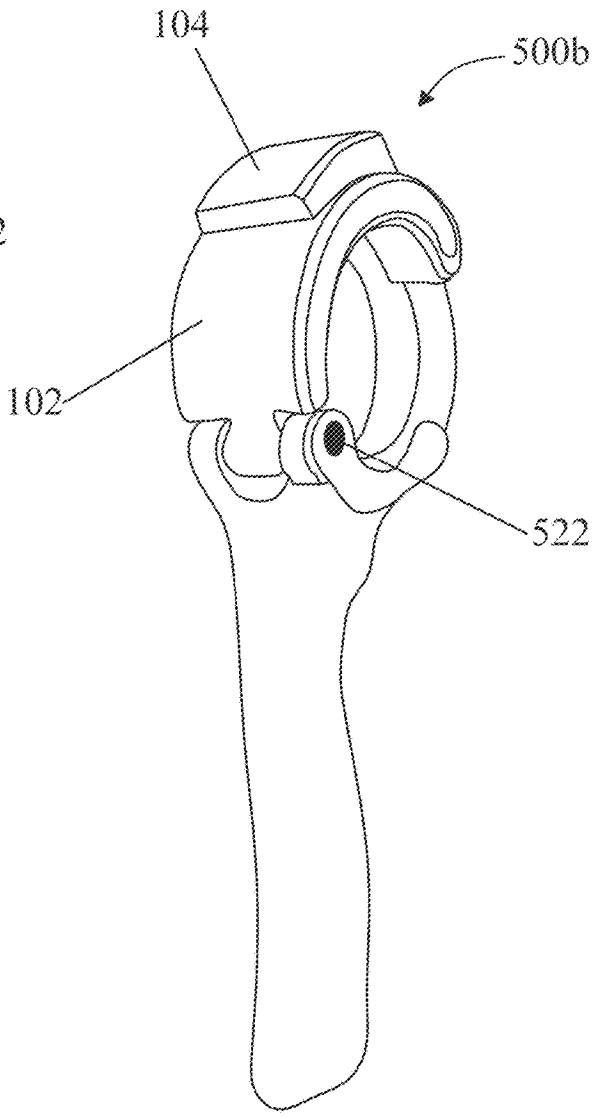
FIGS. 5A and 5B are exemplary embodiments of a component for affixing at least a clamp to a hose or rod.
Figure 5A:
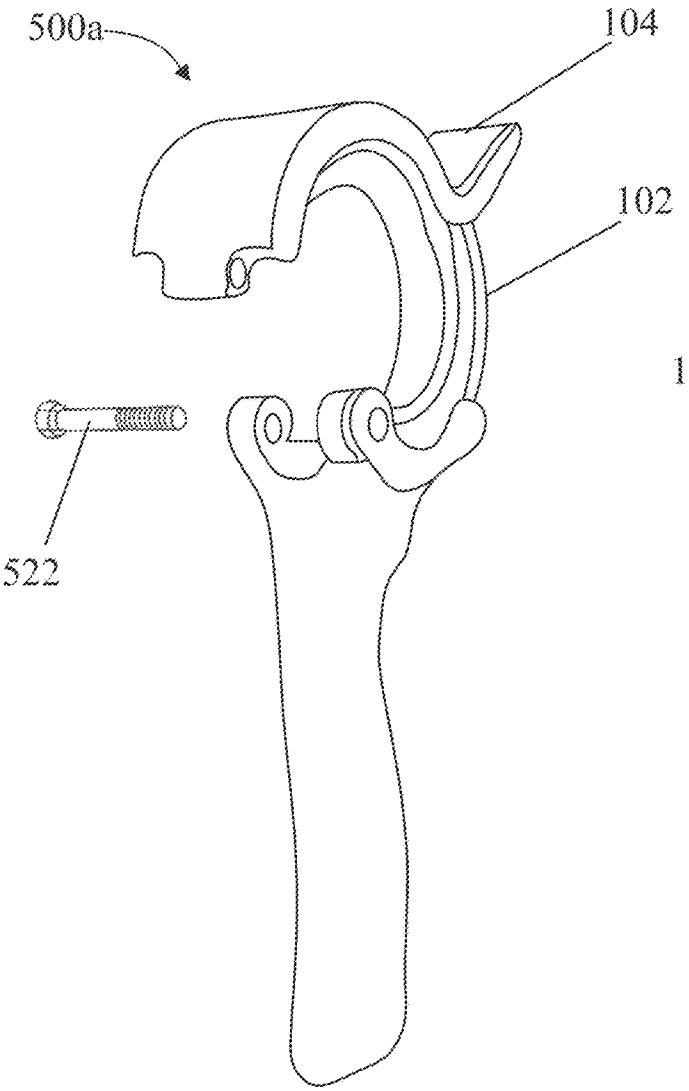

Referring now to FIGS. 5A and 5B, exemplary attachment mechanisms for affixing a handle assembly to a hose or rod are illustrated. FIG. 5A illustrates an open configuration 500*a*, wherein the handle may be secured using an open mechanical fastening interface, which includes a separable clamp structure configured to receive the hose laterally and then be closed into a closed configuration 500*b*. As shown in FIG. 5B, when engaged, the overcenter lever 104 transitions to a closed configuration 500*b*, forming a continuous or substantially continuous ring around the hose or rod. The transition from open configuration 500*a* to closed configuration 500*b* may be accomplished using mechanical locking components such as latches, snap-fits, cam-locks, or threaded fasteners. In another embodiment, the handle may be attached using a removable bolt 522, which passes through aligned apertures in the clamp body to rigidly secure the assembly. Alternative fastening methods may include buckle mechanisms, hook-and-loop straps, or semicircular hooks that engage mating features to form a secure enclosure. These configurations may allow for midline installation onto a hose or rod without requiring access to a free end.

With further reference to FIGS. 5A and 5B, in some aspects, the handle assembly may be configured to allow rapid linear and/or rotational repositioning along the hose. This repositionability may be achieved through use of a clamp 102 formed as a closed ring with an adjustable diameter. The adjustable diameter may be actuated using an overcenter lever or other quick-release mechanism that permits the clamp to alternately engage or disengage the hose. In one configuration, the overcenter lever may be operated by a rotating knob, cam, or other control element positioned for ergonomic access. The clamp's interior surface may include a high-friction material such as rubber or a textured surface such as a knurled insert, both of which improve engagement and reduce slippage during use.

Still referring to FIGS. 5A and 5B, in certain embodiments, the handle may include modular or interchangeable shim inserts to accommodate hoses of varying outer diameters, enhancing the versatility of the handle assembly. The handle grip may be formed as a pistol grip, ergonomic arc, or other user-preferred geometry. Additionally, or alternatively, multiple grip points or auxiliary handles may be mounted to a single clamp 102 to support two-handed operation or improved load distribution during high-force applications. These multiple grips may be radially spaced or axially offset along the clamp body.

In continued reference to FIGS. 5A and 5B, in an embodiment, the overcenter lever used to actuate the clamp 102 may include a rotating knob interface configured to reduce accidental disengagement and improve fine adjustment. In some embodiments, a security latch may be integrated into the assembly to prevent inadvertent actuation of the overcenter lever. The latch may be spring-biased to a locked position and positioned for thumb actuation, requiring deliberate user input to release. The combination of an adjustable clamp, mechanical fastening interface, and ergonomic trigger-ready handle may allow users to dynamically adjust handle position to optimize hose control and minimize fatigue during precision media blasting or other force-intensive tasks.

Figure 6:
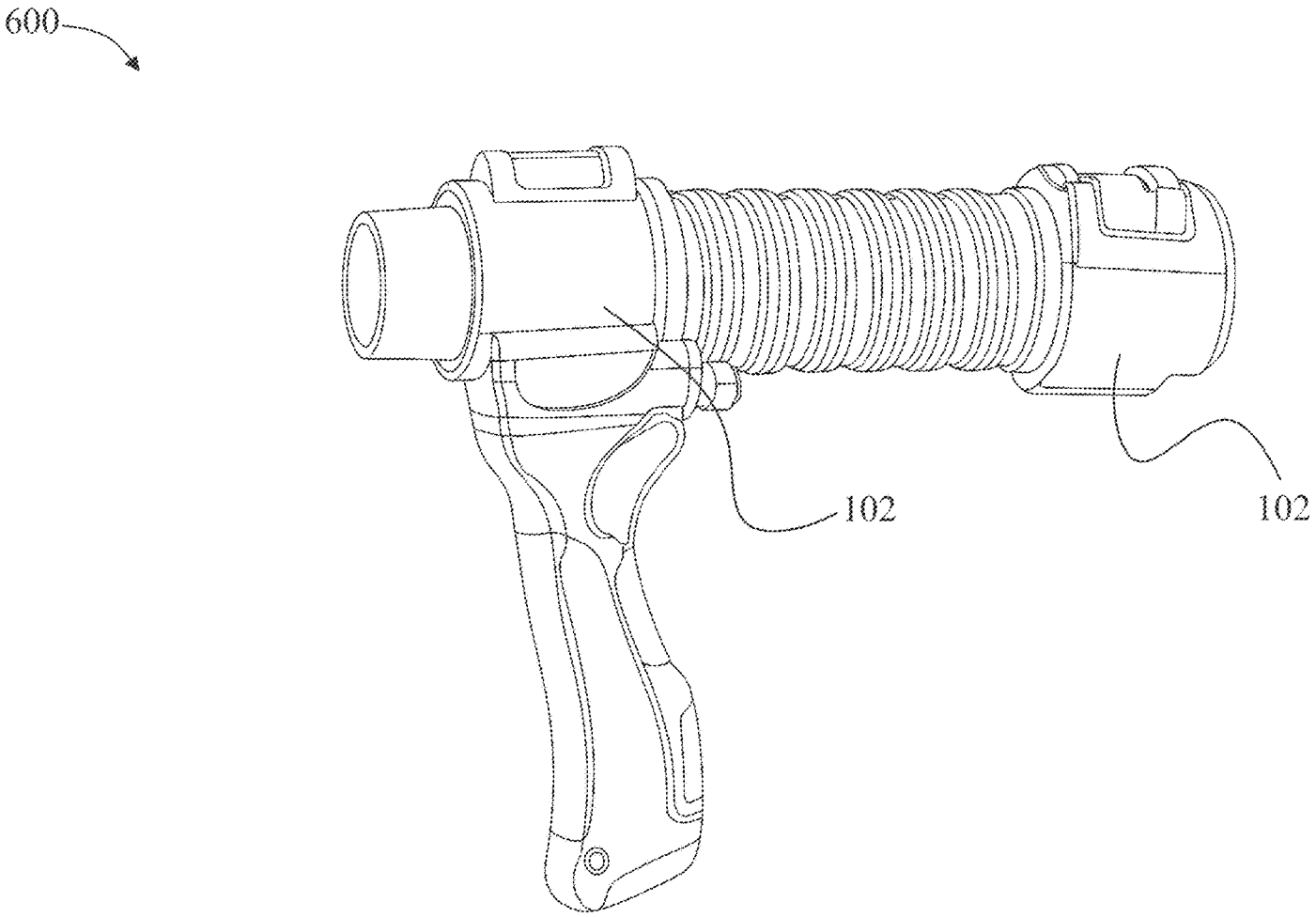
FIG. 6 is an exemplary control line management in connection with at least a clamp.

Referring now to FIG. 6, an isometric view of a control line management system 600 is illustrated. In an embodiment, control line management system 600 may be operatively connected to a clamp 102 and configured to maintain spatial alignment and operational integrity of one or more control lines routed between handle components. In some embodiments, control line management system 600 may include an integrated routing sheath, tensioning conduit, or retention track designed to prevent excessive slack, torsion, or tangling of control lines during handle repositioning. The system may be secured to a hose or rod using the clamp 102 or through independent mounting brackets, thereby ensuring that control lines remain securely affixed and protected during repositioning of the handle assembly. This configuration may allow the handle to be repositioned along the hose or rod without compromising the operation of the actuation system, enhancing the operator's control while reducing fatigue and minimizing safety hazards related to loose or kinked lines.

With continued reference to FIG. 6, in some embodiments, control line management system 600 may be directly mounted to or integrated with clamp 102, such that the repositioning of the clamp preserves the spatial relationship between the control lines and the associated actuating mechanisms. This may be particularly useful in systems where a twin-line pneumatic control interface requires fixed inlet and exhaust routing for reliable operation. The control line management system 600 may include alignment guides, internal or external retention clips, or flexible protective sleeves that span the length between multiple clamps or anchor points. These features may maintain a defined routing path even during linear or rotational adjustments of the handle assembly, supporting both modularity and operational continuity.

In continued reference to FIG. 6, in further embodiments, control line management system 600 may include coupling features or tension-stabilizing components that maintain functional engagement with actuation elements—such as triggers, valves, or sensors-during repositioning events. For example, spring-biased or stretch-resistant sheaths may preserve signal fidelity and prevent accidental disconnection or binding. The system may be designed to accommodate variable hose geometries or hose diameters, enabling compatibility across different setups. Additional clamps 102 may be deployed along the hose to support supplementary handle grips or auxiliary components while ensuring that the control line routing remains intact. This modular, managed configuration may allow for rapid field adjustments while supporting continuous and reliable control of the media blast hose.

Figure 7:
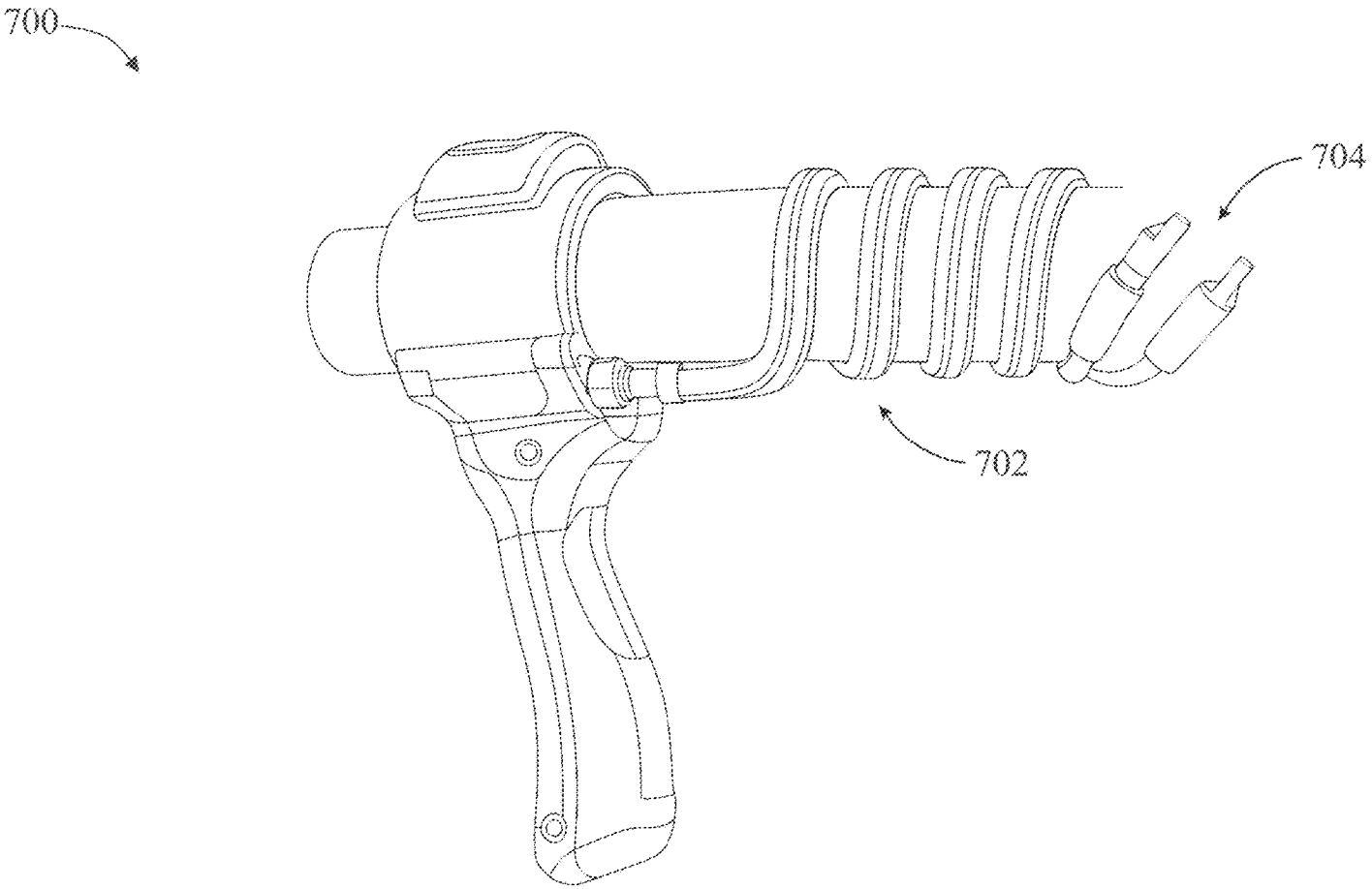
FIG. 7 illustrates an exemplary trigger switch assembly connected to control lines with quick disconnects.

Referring now to FIG. 7, an isometric view of an exemplary handle assembly for a media blast hose 700 connected to control lines 702 with quick disconnects 704 is illustrated. The handle assembly for a media blast hose 700 may be designed for ergonomic one-handed operation and may include an integrated handle grip 110, safety switch 108, and trigger 112. In some embodiments, the control lines 702 extend from the base of the handle and may be operatively coupled to a twin-line pneumatic control system. The control lines 702 may facilitate the delivery of pressurized signal and exhaust flow paths, enabling actuation of a remote blast valve.

In continued reference to FIG. 7, in an embodiment, quick disconnects 704 may be provided at terminal ends of control lines 702 and may be configured to interface with mating ports on a downstream control valve or system interface. In an embodiment, quick disconnects 704 may be implemented as push-to-connect fittings, threaded couplers, or twist-lock pneumatic connectors that allow for tool-free installation and disconnection in the field. These components may support rapid setup, servicing, or modular reconfiguration of the handle assembly. The secure mechanical coupling provided by the quick disconnects 704 may reduce the risk of pressure loss, disconnection, or actuation failure during operation. In some embodiments, the handle grip 110 may be shaped and positioned to guide the user's hand into an optimal operating posture, facilitating single-motion actuation. For example, the geometry may allow the operator to disengage the safety switch 108 and actuate the trigger 112 in a fluid, continuous squeeze using the thenar web or primary digits of the dominant hand. This single-motion operation may reduce user effort and enhance safety by simplifying the transition from a locked to an activated state.

With further reference to FIG. 7, in some configurations, the clamp diameter may be adjustable to accommodate hoses of varying sizes using a threaded rod, shim insert, or an overcenter lever. The overcenter lever may be actuated by a rotating knob or cam to improve ergonomics and prevent accidental loosening. In certain embodiments, a security latch may be positioned near the lever for thumb activation, providing an additional mechanical lockout to prevent unintended actuation.

In further reference to FIG. 7, the handle assembly may support a variety of configurations including multiple handle grips mounted to a single closed ring. These may include primary grips with trigger mechanisms and secondary grips for stability or maneuvering. Modular components may be used to customize handle type, orientation, or actuation features for different applications. In one example, the trigger mechanism may include a two-lever structure in which a primary safety switch mechanically prevents trigger movement until rotated through a predefined arc. Once cleared, the trigger 112 may pivot freely to initiate control line activation. In a resting state, the safety switch and trigger may be recessed or flush with the surrounding grip body to reduce snag risk and improve comfort. In an embodiment, the trigger 112 may be positioned on the proximal side of the handle relative to the operator and oriented in alignment with the gravitational force vector of the hose. This configuration may leverage the weight of the system to reduce required actuation force and may support long-duration operation with reduced fatigue.

Still referring to FIG. 7, in some embodiments, the system may further include a feeder line management system that allows control lines 702 to remain securely routed even as the handle is repositioned along the hose axis. This configuration may enable modular or on-the-fly adjustment of grip position without compromising signal integrity. Secondary handles may also be affixed to the system without integrated triggers. These may be used in conjunction with the primary actuation handle to improve directional control, especially in high-force applications like media blasting. The modular handle design may allow a mix of ergonomic styles to be installed along the same hose to suit operator preference or operational demands.

In further reference to FIG. 7, in an embodiment, all components of the handle assembly for a media blast hose may be designed to support modularity and ergonomic optimization. The activation and fail-to-safe systems may be fully integrated into the handle profile to reduce user strain. This may allow production of multiple handle shapes, sizes, and force-response profiles tailored to specific job functions or user populations. The resulting system may reduce fatigue, improve control precision, and mitigate long-term risk of musculoskeletal injury.

Figure 8:
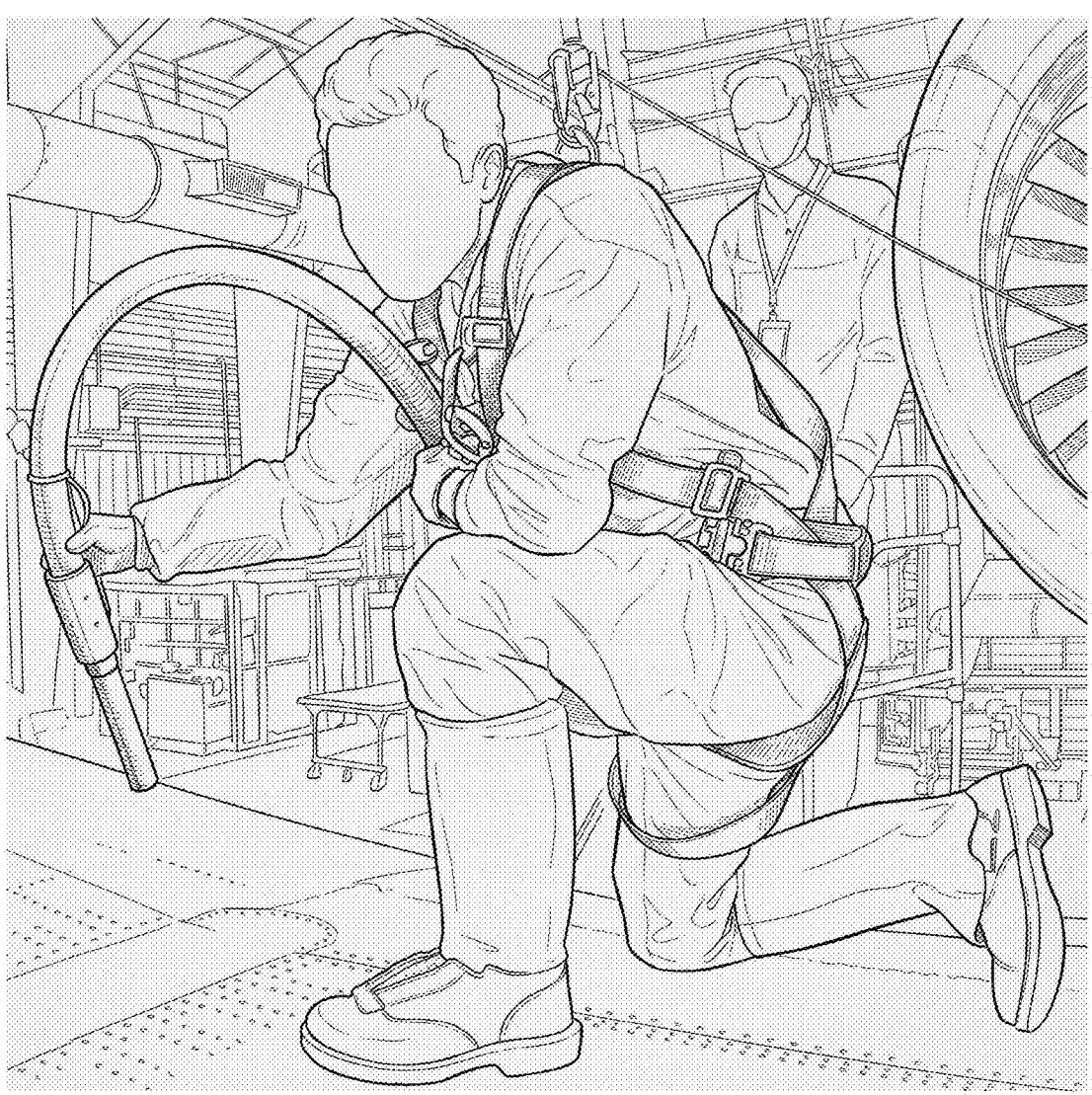
FIG. 8 illustrates an individual using a traditional media blast hose without an attached handle.

Referring now to FIG. 8, a depiction 800 of an individual operating a traditional media blast hose without an attached handle assembly is illustrated. The figure shows the operator grasping the bare hose directly, with the forearm and wrist positioned in a manner that may be ergonomically suboptimal. This posture may result in increased muscular strain, reduced directional control, and a heightened risk of fatigue or repetitive-use injury during prolonged blasting operations.

The configuration shown in FIG. 8 highlights common challenges associated with traditional media blast hose setups that lack integrated handle grips or trigger mechanisms. Without a designated ergonomic interface, operators may be required to exert continuous grip force on a heavy, vibration-prone hose, leading to reduced operational precision and increased risk of injury. This illustration is provided to contrast the benefits of the trigger switch assembly disclosed herein, which includes a repositionable handle grip, ergonomic activation geometry, and fail-to-safe actuation features designed to mitigate the ergonomic limitations depicted.

Figure 9:
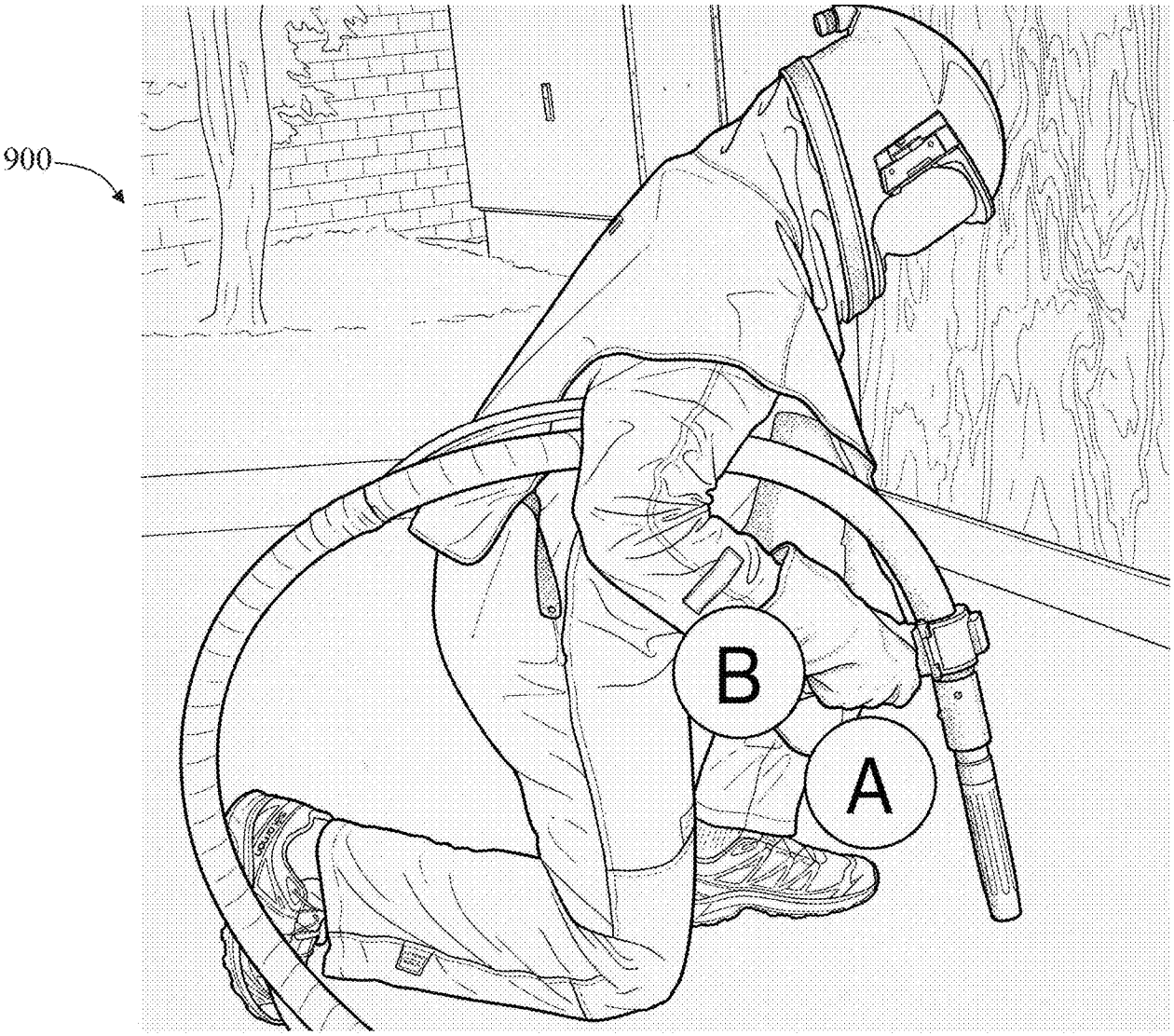
FIG. 9 is a depiction of an operator using a media blast hose with an ergonomic handle and trigger mechanism.

Referring now to FIG. 9, a depiction 900 of an operator using a media blast hose (noted at point A) equipped with an ergonomic handle assembly and integrated trigger mechanism (noted at point B). In contrast to the configuration illustrated in FIG. 8, the operator's hand is shown grasping a pistol-style handle grip, with the wrist in a neutral, ergonomically favorable posture. This grip orientation may reduce torsional strain, support more precise directional control, and enhance stability during extended use.

The configuration of FIG. 9 demonstrates the ergonomic and operational advantages of the handle assembly described in the present disclosure. By incorporating features such as a thenar-actuated trigger, repositionable mounting, and integrated safety mechanisms, the handle assembly allows the operator to maintain a comfortable grip with reduced muscular load. This may result in improved control accuracy, decreased fatigue, and a lower risk of musculoskeletal injury. The depicted improvement in posture and usability underscores the potential for increased operator productivity, reduced downtime, and greater overall safety in abrasive blasting environments.

Figures 10A, 10B:
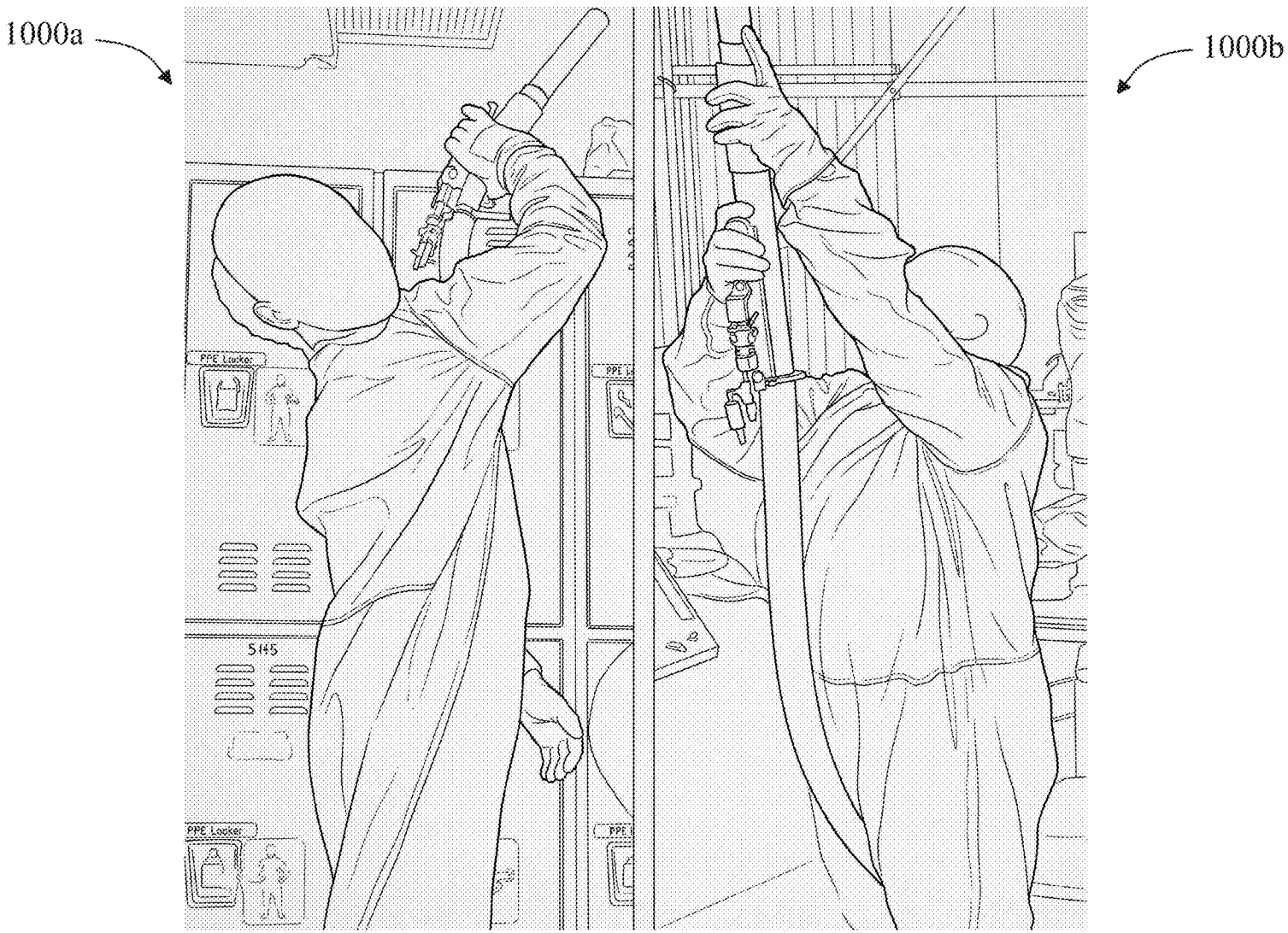
FIGS. 10A and 10B illustrate two side-by-side images demonstrating the use of a traditional media blast tool without an ergonomic handle.

Referring now to FIGS. 10A and 10B, two comparative illustrations are presented depicting conventional usage of a media blast tool without an integrated ergonomic handle assembly. In a first depiction 1000*a* in FIG. 10A a traditional activation switch is positioned above the hose during operation, requiring the operator to manually stabilize the hose while independently actuating the switch. In the second depiction 1000*b* in FIG. 10B, the same tool is operated with the switch located below the hose, resulting in an alternate grip configuration. These traditional setups highlight ergonomic challenges commonly encountered in media blasting workflows, including unnatural wrist articulation, uneven load distribution, and reduced directional control. Operators may be required to exert significant effort to stabilize the hose and manipulate a detached switch, which may contribute to increased fatigue and risk of repetitive strain injury. The configurations illustrated in FIGS. 10A and 10B underscore the practical limitations of legacy designs and further highlight the ergonomic and operational improvements offered by the integrated trigger switch assembly disclosed herein.

Figures 11A, 11B, 11C:
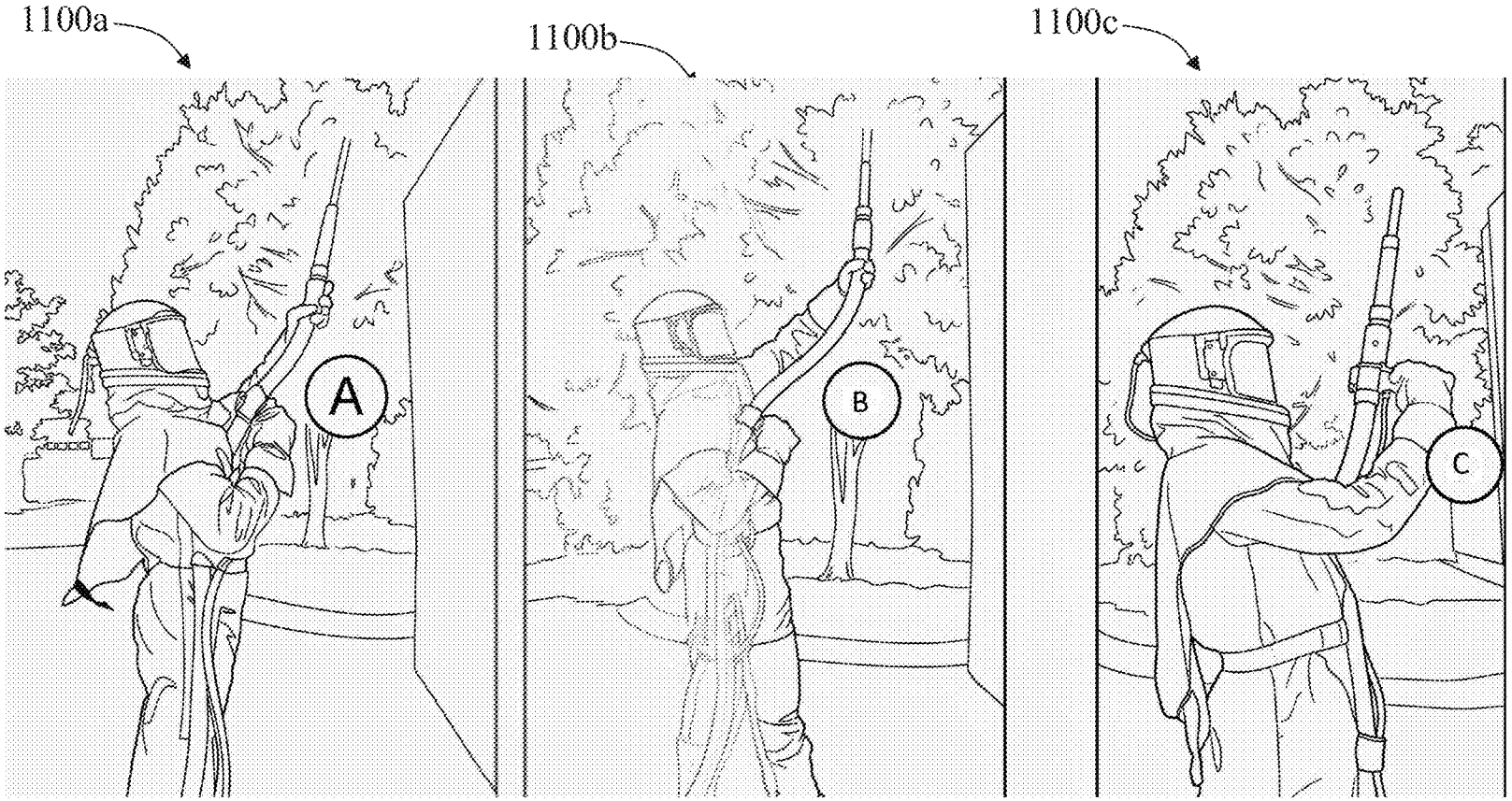
FIGS. 11A, 11B, and 11C illustrate a series of three images showing a person demonstrating the use of an ergonomic fail-to-safe trigger/switch with rapidly adjustable securement on a media blast hose.

Referring now to FIGS. 11A, 11B, and 11C, a series of three illustrations depict an operator demonstrating various ergonomic configurations of a fail-to-safe trigger/switch assembly with rapidly adjustable securement mounted to a media blast hose. In the first configuration in FIG. 11A, configuration 1100*a* at position A, the trigger/switch is positioned near the nozzle end of the hose, providing the operator with close-proximity control that may be particularly advantageous for detail-oriented or precision blasting operations. This positioning may allow for fine directional manipulation and improved surface targeting during intricate tasks.

In continued reference to FIGS. 11A, 11B, and 11C, in the second configuration in FIG. 11B, configuration 1100*b* at position B, the trigger/switch is shown mounted further back along the hose. This arrangement may provide a more neutral load distribution across the operator's arm and shoulder, reducing biomechanical strain and operator fatigue during prolonged or repetitive blasting sessions. This configuration may be ideal for tasks requiring extended durations of continuous operation.

With continued reference to FIGS. 11A, 11B, and 11C, in the third configuration in FIG. 11C, configuration 1100*c* at position C, the trigger/switch is positioned approximately at the midpoint of the hose. This intermediate location may strike a balance between ergonomic comfort and directional control, allowing the operator to maintain stable support while retaining sufficient manipulation leverage for broad or irregular surface blasting. The positional flexibility of the handle assembly as demonstrated across these configurations may enable dynamic adaptation to a range of task-specific requirements and user preferences.

In further reference to FIGS. 11A, 11B, and 11C, the ability to rapidly reposition the trigger/switch assembly along the media blast hose, as illustrated in FIGS. 11A, 11B, and 11C, underscores the enhanced usability and ergonomic customization provided by the systems and methods described herein. The closed ring clamp mechanism, in conjunction with the overcenter lever and optional shim inserts, may allow operators to quickly adjust the handle location without tools or disassembly. This adjustability may improve both comfort and operational efficiency while contributing to a reduction in the risk of repetitive strain injuries or musculoskeletal disorders over time.

Figure 12:
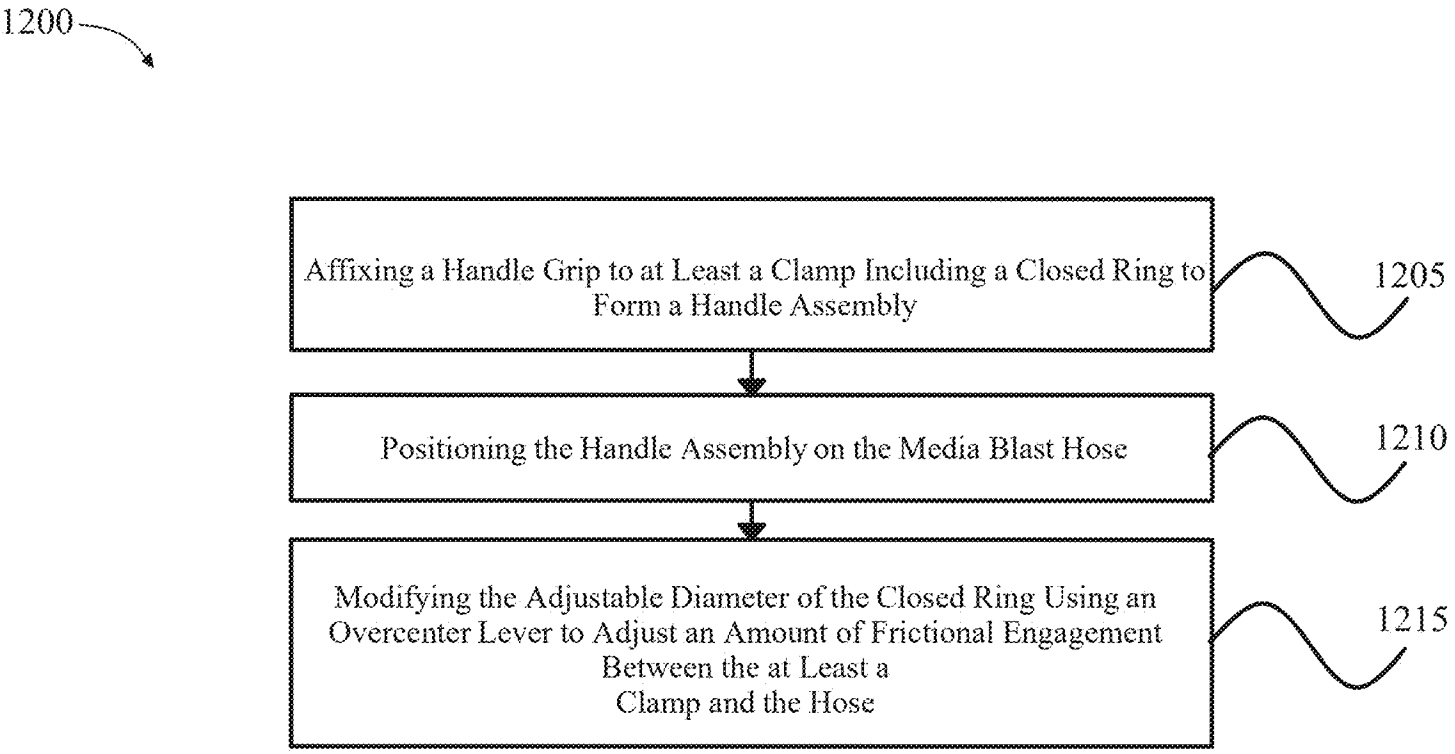
FIG. 12 is a flow diagram of an exemplary method for attaching a handle assembly to a media blast hose.

Now referring to FIG. 12, method 1200 for attaching a handle assembly to a media blast hose is illustrated. Method 1200 may include a step 1205 of affixing a handle grip to at least a clamp including a closed ring to form a handle assembly. This may be implemented, without limitation, as referenced in FIGS. 1-11C.

In continued reference to FIG. 1200, method 1200 may include a step 1210 of positioning the handle assembly on the media blast host. In an embodiment, the handle grip may further include a trigger mechanism. In such an embodiment, method 1200 may further include manually displacing a safety switch through an arc of motion between approximately 15 and 30 degrees to unrestrict a trigger and actuating the trigger to activate a control connection that modifies an operating state of the media blast hose. In an embodiment, the at least a clamp may include a first clamp and a second clamp. In such an embodiment, method 1200 may further include affixing the first clamp to the hose at a first position and affixing the second clamp to the hose at a second position, wherein the second position differs from the first position. This may be implemented, without limitation, as referenced in FIGS. 1-11C.

With further reference to FIG. 12, method 1200 may include a step 1215 of modifying an adjustable diameter of the closed ring using an overcenter lever to adjust frictional engagement between the at least a clamp and the hose. This may be implemented, without limitation, as referenced in FIGS. 1-11C.

Still referring to FIG. 12, method 1200 may further include disengaging the overcenter lever to expand the adjustable diameter of the closed ring, repositioning the handle assembly linearly and rotationally along the hose as a function of an operational need, and actuating the overcenter lever to reduce the adjustable diameter of the closed ring and resecure the handle assembly in place using frictional engagement. This may be implemented, without limitation, as referenced in FIGS. 1-11C.

With continued reference to FIG. 12, method 1200 may further include selecting a shim insert corresponding to a diameter of he media blast hose, inserting the shim insert into an interior surface of the closed ring, and mounting the handle assembly one the hose using the at least a clamp with the shim insert to achieve a friction fit. This may be implemented, without limitation, as referenced in FIGS. 1-11C.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods and systems according to the present disclosure. Accordingly, this description is meant to be taken only by way of example, and not to otherwise limit the scope of this invention. Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A handle assembly for a media blast hose, comprising:
a handle grip; and
a clamp affixed to the handle grip and configured to secure the handle assembly to the media blast hose, wherein:
the clamp comprises:
a closed ring; and
a mechanism configured to adjust an amount of friction between the clamp and the media blast hose, wherein the mechanism when actuated reduces a diameter of the closed ring to position the clamp from a first engagement position to a second engagement position wherein:
the first engagement position of the clamp comprises a first predetermined diameter of the closed ring to configure the handle assembly to be linearly and rotationally independent of the media blast hose to allow for repositioning during use of the handle assembly in a continuous motion without detaching or removing the clamp from the media blast hose; and
the second engagement position of the clamp comprises a second predetermined diameter of the closed ring to configure the handle assembly to be rigidly attached to the media blast hose through frictional engagement.

2. The handle assembly of claim 1, wherein the closed ring comprises:
a friction material layer comprising material having a static coefficient of friction of at least 0.6, wherein the friction material layer is configured to resist slippage between the clamp and the media blast hose when the clamp is in the second engagement position.

3. The handle assembly of claim 1, wherein the closed ring comprises a plurality of circumferentially spaced mounting regions configured to receive and secure the handle grip.

4. The handle assembly of claim 1, wherein the clamp comprises a security feature positioned adjacent to the mechanism and configured to restrict movement of the mechanism.

5. The handle assembly of claim 1, wherein the clamp further comprises a release mechanism, wherein the release mechanism comprises:
at least two separable segments of the closed ring; and
a mechanical fastening interface configured to mechanically connect the at least two separable segments of the closed ring, wherein the two separable segments are configured to encircle the media blast hose.

6. The handle assembly of claim 1, wherein the handle grip comprises a pistol grip handle wherein the pistol grip handle is configured to permit single-handed actuation of the mechanism.

7. The handle assembly of claim 1, wherein the handle grip is removably connected to the clamp by a mechanical fastening interface.

8. The handle assembly of claim 1, wherein the handle grip further comprises a trigger mechanism, wherein the trigger mechanism comprises:
a safety switch positioned adjacent to a trigger;
the trigger operably coupled to the safety switch; and
a control connection situated within the handle assembly and operably connected to both the safety switch and the trigger, wherein the control connection is configured to control an operating state of the media blast hose in response to activation of the safety switch when the trigger is engaged.

9. The handle assembly of claim 8, wherein the safety switch is configured to physically obstruct movement of the trigger until the safety switch is displaced through an arc of motion within a range of approximately 15 to 30 degrees.

10. The handle assembly of claim 8, wherein:

in an operating position of the handle assembly, the trigger mechanism is aligned with a user's palm.

11. The handle assembly of claim 8, wherein the trigger mechanism is:

positioned on a proximal side of the handle grip relative to a user; and oriented in a direction aligned with a force vector of the media blast hose during operation.

12. The handle assembly of claim 1, wherein reducing the diameter of the closed ring comprises a circumferential clamping force that compresses the media blast hose radially inward and resists axial and rotational movement of the handle assembly during use.

13. The handle assembly of claim 12, wherein actuation of the closed ring is configured to apply the circumferential clamping force to an outer surface of the media blast hose of at least 40 pounds of force.

14. The handle assembly of claim 1, further comprising a second clamp affixed to the media blast hose at a position spaced apart from the clamp to provide distributed stability.

15. The handle assembly of claim 1, wherein the first predetermined diameter of the closed ring comprises an expanded position and the second predetermined diameter of the closed ring comprises a contracted position.

16. A method for attaching a handle assembly to a media blast hose, the method comprising:

affixing a handle grip to a clamp comprising a closed ring to form a handle assembly;

positioning the handle assembly on the media blast hose using a mechanism configured to adjust an amount of friction between the clamp and the media blast hose, wherein the mechanism when actuated reduces a diameter of the closed ring to position the clamp from a first engagement position to a second engagement position wherein:

the first engagement position of the clamp comprises a first predetermined diameter of the closed ring to configure the handle assembly to be linearly and rotationally independent of the media blast hose to allow for repositioning during use of the handle assembly in a continuous motion without detaching or removing the clamp from the media blast hose; and the second engagement position of the clamp comprises a second predetermined diameter of the closed ring to configure the handle assembly to be rigidly attached to the media blast hose through frictional engagement.

17. The method of claim 16, wherein the handle grip comprises a trigger mechanism, the method further comprising:

manually displacing a safety switch through an arc of motion between approximately 15 and 30 degrees to unblock a trigger; and actuating the trigger to activate a control connection that modifies an operating state of the media blast hose.

18. The method of claim 16, wherein reducing the diameter of the closed ring comprises a circumferential clamping force that compresses the media blast hose radially inward and resists axial and rotational movement of the handle assembly during use.

19. The handle assembly of claim 18, wherein actuation of the closed ring is configured to apply the circumferential clamping force to an outer surface of the media blast hose of at least 40 pounds of force.

20. The method of claim 16, wherein the first predetermined diameter of the closed ring comprises an expanded position and the second predetermined diameter of the closed ring comprises a contracted position.

* * * * *